US010176952B2

(12) United States Patent
Itoda et al.

(10) Patent No.: US 10,176,952 B2
(45) Date of Patent: Jan. 8, 2019

(54) ELECTROMAGNETIC RELAY

(71) Applicant: OMRON Corporation, Kyoto-shi, Kyoto (JP)

(72) Inventors: Syuichi Itoda, Kusatsu (JP); Masayuki Noda, Yamaga (JP); Koji Takami, Kyoto (JP); Takeshi Nishida, Kusatsu (JP); Yasuo Hayashida, Kumamoto (JP); Keisuke Yano, Kikuchi (JP); Ayaka Miyake, Kikuchi (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/509,914

(22) PCT Filed: Jul. 27, 2015

(86) PCT No.: PCT/JP2015/071275
§ 371 (c)(1),
(2) Date: Mar. 9, 2017

(87) PCT Pub. No.: WO2016/088402
PCT Pub. Date: Jun. 9, 2016

(65) Prior Publication Data

US 2017/0301494 A1 Oct. 19, 2017

(30) Foreign Application Priority Data

Dec. 5, 2014 (JP) ..... 2014-247345

(51) Int. Cl.
*H01H 51/22* (2006.01)
*H01H 50/38* (2006.01)
(Continued)

(52) U.S. Cl.
CPC ..... *H01H 50/38* (2013.01); *H01H 50/02* (2013.01); *H01H 50/54* (2013.01); *H01H 50/58* (2013.01);
(Continued)

(58) Field of Classification Search
CPC ..... H01H 50/02; H01H 50/38; H01H 50/54; H01H 2205/002
(Continued)

(56) References Cited

U.S. PATENT DOCUMENTS 2,725,488 A * 11/1955 Hueffed ..... H01H 51/065 290/36 R
3,103,563 A * 9/1963 Grenier ..... H01H 1/20 335/145
(Continued)

FOREIGN PATENT DOCUMENTS

CN 101388303 A 3/2009
CN 201311887 Y 9/2009
(Continued)

OTHER PUBLICATIONS

The Chinese Office Action dated Mar. 30, 2018 in a related Chinese Patent application.
(Continued)

*Primary Examiner* — Shawki S Ismail
*Assistant Examiner* — Lisa Homza
(74) *Attorney, Agent, or Firm* — Metrolexis Law Group, PLLC

(57) ABSTRACT

Provided is an electromagnetic relay that is reduced in size and has great flexibility in designing. For this purpose, when a predetermined time has passed after generation of an arc at least either between a movable contact and a fixed contact or between a movable contact and a fixed contact, an arc generated between the movable contact and the fixed contact is extended by a magnetic field generation unit to be longer than an arc generated between the movable contact and the fixed contact.

3 Claims, 27 Drawing Sheets

(51) Int. Cl.

| | |
|---|---|
| ***H01H 50/58*** | (2006.01) |
| ***H01H 50/54*** | (2006.01) |
| ***H01H 50/02*** | (2006.01) |
| ***H01H 50/60*** | (2006.01) |
| *H01H 50/42* | (2006.01) |

(52) U.S. Cl.
CPC ..... *H01H 50/60* (2013.01); *H01H 50/42* (2013.01); *H01H 2205/002* (2013.01); *H01H 2235/01* (2013.01)

(58) Field of Classification Search
USPC ..... 335/78
See application file for complete search history.

(56) References Cited

U.S. PATENT DOCUMENTS 3,364,450 A * 1/1968 Conner ..... H01H 50/22 335/170
3,388,353 A * 6/1968 Isler ..... H01H 11/0012 335/132
3,441,800 A * 4/1969 Lee ..... H01H 9/56 218/140
3,518,589 A 6/1970 Koehler
3,544,929 A * 12/1970 Kussy ..... H01H 1/2083 335/126
3,688,230 A * 8/1972 Tichy ..... H01H 50/42 335/201
3,745,492 A * 7/1973 Grunert ..... H01H 50/32 335/167
3,942,144 A * 3/1976 Contal ..... H01H 50/546 335/132
4,068,200 A * 1/1978 Krueger ..... H01H 9/342 200/50.1
4,129,843 A * 12/1978 Keller ..... H01H 71/345 335/174
4,259,652 A * 3/1981 Mattson ..... H01H 51/2281 335/128
4,266,105 A * 5/1981 Perkins, Jr. ..... H01H 71/7463 200/325
4,307,361 A * 12/1981 Grunert ..... H01H 51/10 335/167
4,367,448 A 1/1983 Nishizako
4,401,863 A * 8/1983 Lemmer ..... H01H 50/546 200/16 A
4,404,443 A 9/1983 Coynel et al.
4,475,094 A * 10/1984 Grenier ..... H01H 50/32 335/138
4,484,165 A * 11/1984 Grenier ..... H01H 50/32 335/165
4,529,953 A * 7/1985 Myers ..... H01H 51/005 335/126
4,590,449 A * 5/1986 VanTielen ..... H01H 50/047 335/126
4,631,507 A * 12/1986 Guery ..... H01H 71/2409 335/173
4,644,308 A * 2/1987 Guery ..... H01H 89/08 200/307
4,688,011 A * 8/1987 Lemmer ..... H01H 89/08 335/120
4,713,636 A * 12/1987 Lemmer ..... H01H 89/08 335/172
4,808,952 A * 2/1989 Berner ..... H01H 71/1081 335/119
4,931,757 A * 6/1990 Lemmer ..... H01H 89/06 335/131
4,973,929 A * 11/1990 Duchemin ..... H01H 71/0228 335/132
5,109,146 A 4/1992 Maenishi
5,119,053 A * 6/1992 Mostosi ..... H01H 89/08 335/172
5,256,992 A * 10/1993 Fasola ..... H01H 51/065 335/126
5,293,521 A * 3/1994 Blanchard ..... H01H 9/22 335/132
5,500,630 A * 3/1996 Edwards, Jr. ..... H01H 71/1054 335/132
5,502,426 A * 3/1996 Blanchard ..... H01H 71/56 335/132
5,517,167 A * 5/1996 Yamamoto ..... H01F 5/04 335/132
5,638,038 A * 6/1997 Suzuki ..... H01H 9/542 335/35
5,684,442 A * 11/1997 Hufschmid ..... H01H 50/443 335/132
5,867,081 A * 2/1999 Arnoux ..... H01H 51/22 335/132
5,986,529 A 11/1999 Miyata et al.
6,116,558 A 9/2000 Yano
6,911,884 B2 * 6/2005 Uotome ..... H01H 47/06 335/132
6,956,728 B2 * 10/2005 Zhou ..... H01H 9/563 361/160
7,098,763 B2 * 8/2006 Larcher ..... H01H 9/345 335/132
7,760,055 B2 * 7/2010 Adunka ..... H01H 1/0015 335/132
7,852,178 B2 * 12/2010 Bush ..... H01H 51/2209 335/126
7,859,373 B2 * 12/2010 Yamamoto ..... H01H 50/305 335/126
7,915,985 B2 3/2011 Schmitz et al.
8,138,440 B2 * 3/2012 Onufriyenko ..... H01H 73/045 218/154
8,248,193 B2 * 8/2012 Kaneda ..... F02N 15/067 335/126
8,791,777 B2 * 7/2014 Wan ..... H01H 50/326 335/132
9,064,664 B2 * 6/2015 Yamamoto ..... H01H 1/32
9,532,476 B2 * 12/2016 Mills ..... H01H 45/04
2003/0090351 A1 * 5/2003 Chen ..... H01H 9/42 335/132
2004/0109293 A1 * 6/2004 Apfelbacher ..... H01H 50/021 361/709
2004/0257182 A1 12/2004 Saruwatari et al.
2004/0263293 A1 12/2004 Saruwatari et al.
2005/0007221 A1 1/2005 Saruwatari et al.
2005/0052263 A1 3/2005 Saruwatari et al.
2005/0242907 A1 11/2005 Minowa et al.
2007/0126538 A1 * 6/2007 Liu ..... H01H 50/32 335/172
2009/0066450 A1 * 3/2009 Yano ..... H01H 49/00 335/203
2009/0072935 A1 3/2009 Yuba et al.
2010/0060394 A1 3/2010 Nagura et al.
2010/0066471 A1 3/2010 Nagura et al.
2010/0165535 A1 * 7/2010 Pohl ..... H01F 7/1615 361/160
2010/0265629 A1 * 10/2010 Beckerman ..... H01H 47/22 361/160
2011/0181381 A1 7/2011 Sasaki et al.
2012/0206222 A1 8/2012 Gruner
2012/0313737 A1 12/2012 Iwamoto et al.
2013/0057369 A1 * 3/2013 Yano ..... H01H 1/66 335/156
2013/0240495 A1 * 9/2013 Yano ..... H01H 9/36 219/123
2013/0293324 A1 11/2013 Fujimoto et al.
2014/0225688 A1 8/2014 Masui et al.
2014/0225689 A1 8/2014 Masui et al.
2014/0265995 A1 * 9/2014 Kinsella ..... H02P 1/26 318/778
2015/0042423 A1 2/2015 Hoffmann et al.
2015/0055268 A1 * 2/2015 Chapel ..... H01H 47/02 361/160
2015/0235791 A1 * 8/2015 Agarwal ..... H01H 50/54 361/57
2017/0076893 A1 * 3/2017 Tsutsui ..... H01H 50/023
2017/0076894 A1 3/2017 Tsutsui et al.
2017/0301494 A1 * 10/2017 Itoda ..... H01H 50/38

(56) References Cited

U.S. PATENT DOCUMENTS

| | | | | |
|---|---|---|---|---|
| 2017/0301495 | A1* | 10/2017 | Hayashida | H01H 50/38 |
| 2017/0301496 | A1* | 10/2017 | Hayashida | H01H 50/38 |
| 2017/0309429 | A1* | 10/2017 | Hayashida | H01H 50/02 |

FOREIGN PATENT DOCUMENTS

| | | | |
|---|---|---|---|
| CN | 101667508 | A | 3/2010 |
| CN | 102129935 | A | 7/2011 |
| CN | 102820172 | A | 12/2012 |
| CN | 103367042 | A | 10/2013 |
| JP | S51-104337 | U | 8/1976 |
| JP | S56-37351 | U | 4/1981 |
| JP | S60-107551 | U | 7/1985 |
| JP | H01-103242 | U | 7/1989 |
| JP | H06-9102 | U | 2/1994 |
| JP | H10-214554 | A | 8/1998 |
| JP | 2000-299045 | A | 10/2000 |
| JP | 2009-224150 | A | 10/2009 |
| JP | 2010-177159 | A | 8/2010 |
| JP | 2012-221701 | A | 11/2012 |
| JP | 2013-080692 | A | 5/2013 |

OTHER PUBLICATIONS

The Chinese Office Action dated Apr. 3, 2018 in a related Chinese Patent application.

The Chinese Office Action dated Apr. 4, 2018 in a related Chinese Patent application.

The Japanese Office Action dated May 29, 2018 in a related Japanese application.

U.S. Office action dated Sep. 27, 2018 in the related U.S. Appl. No. 15/509,998.

* cited by examiner

Fig.27

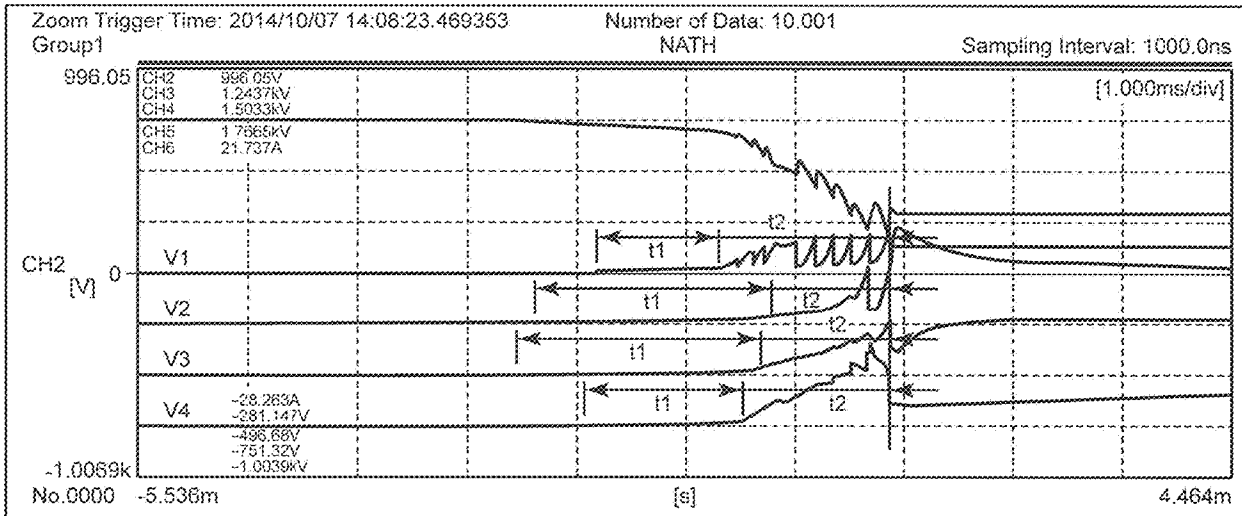

| | FIXED CONTACT | MOVABLE CONTACT | V | B (mH) | d | t1 (ms) | t2 (ms) | t1+t2 (ms) |
|---|---|---|---|---|---|---|---|---|
| ① | 21a | 86a | V1 | 46 | d1 | 1.10 | 1.55 | 2.65 |
| ② | 22a | 86b | V2 | 24 | d2 | 2.20 | 1.05 | 3.25 |
| ③ | 23a | 87a | V3 | 24 | d3 | 2.30 | 1.20 | 3.50 |
| ④ | 24a | 87b | V4 | 46 | d4 | 1.45 | 1.40 | 2.85 |

V VOLTAGE BETWEEN FIXED CONTACT AND MOVABLE CONTACT
B MAGNETIC FLUX DENSITY IN VICINITIES OF CONTACTS AT TIME OF CONTACTING BETWEEN CONTACTS
d SPACING (d1 = d2 = d3 = d4) BETWEEN CONTACTS AT TIME OF SEPARATION OF CONTACTS
t1 TIME FROM GENERATION OF ARC AT TIME OF SEPARATION BETWEEN FIXED CONTACT AND MOVABLE CONTACT TO START OF EXTENSION OF ARC
t2 TIME FROM START OF EXTENSION OF ARC TO COMPLETION OF CUT-OFF OF ARC
t1+t2 ARC CONTINUATION TIME

Fig.28

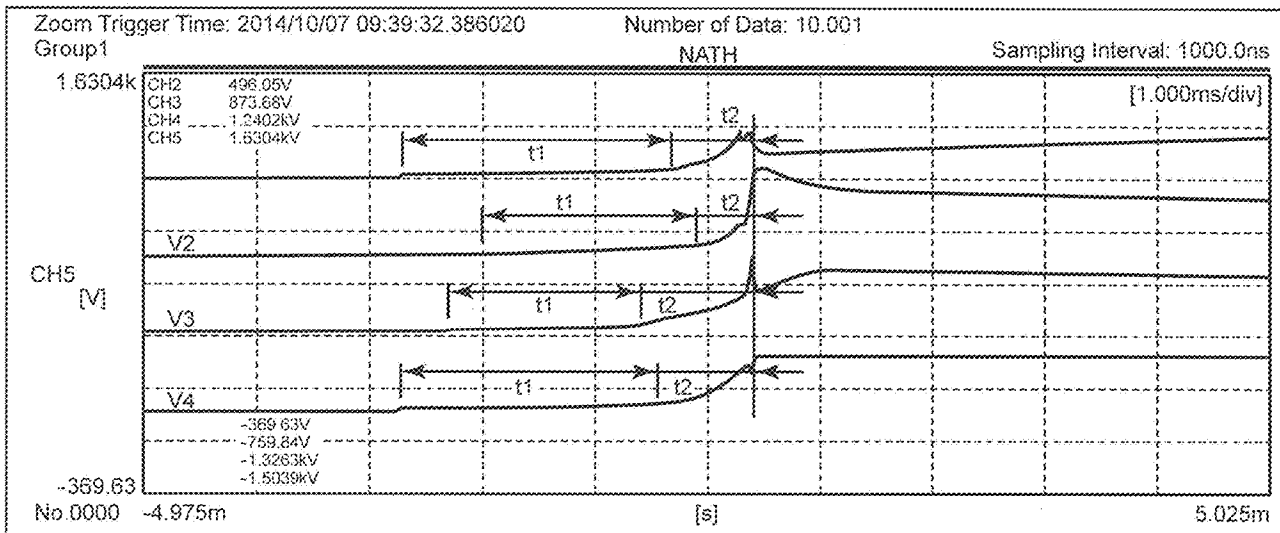

| | FIXED CONTACT | MOVABLE CONTACT | V | B (mH) | d | t1 (ms) | t2 (ms) | t1+t2 (ms) |
|---|---|---|---|---|---|---|---|---|
| ① | 21a | 86a | V1 | 24 | d1 | 2.40 | 0.70 | 3.10 |
| ② | 22a | 86b | V2 | 24 | d2 | 1.90 | 0.50 | 2.40 |
| ③ | 23a | 87a | V3 | 24 | d3 | 1.70 | 1.00 | 2.70 |
| ④ | 24a | 87b | V4 | 24 | d4 | 2.25 | 0.85 | 3.10 |

V VOLTAGE BETWEEN FIXED CONTACT AND MOVABLE CONTACT
B MAGNETIC FLUX DENSITY IN VICINITIES OF CONTACTS AT TIME OF CONTACTING BETWEEN CONTACTS
d SPACING ($d1>d2$, $d3<d4$, $d1=d4$, $d2=d3$) BETWEEN CONTACTS AT TIME OF SEPARATION OF CONTACTS
t1 TIME FROM GENERATION OF ARC AT TIME OF SEPARATION BETWEEN FIXED CONTACT AND MOVABLE CONTACT TO START OF EXTENSION OF ARC
t2 TIME FROM START OF EXTENSION OF ARC TO COMPLETION OF CUT-OFF OF ARC
t1+t2 ARC CONTINUATION TIME

Fig.29

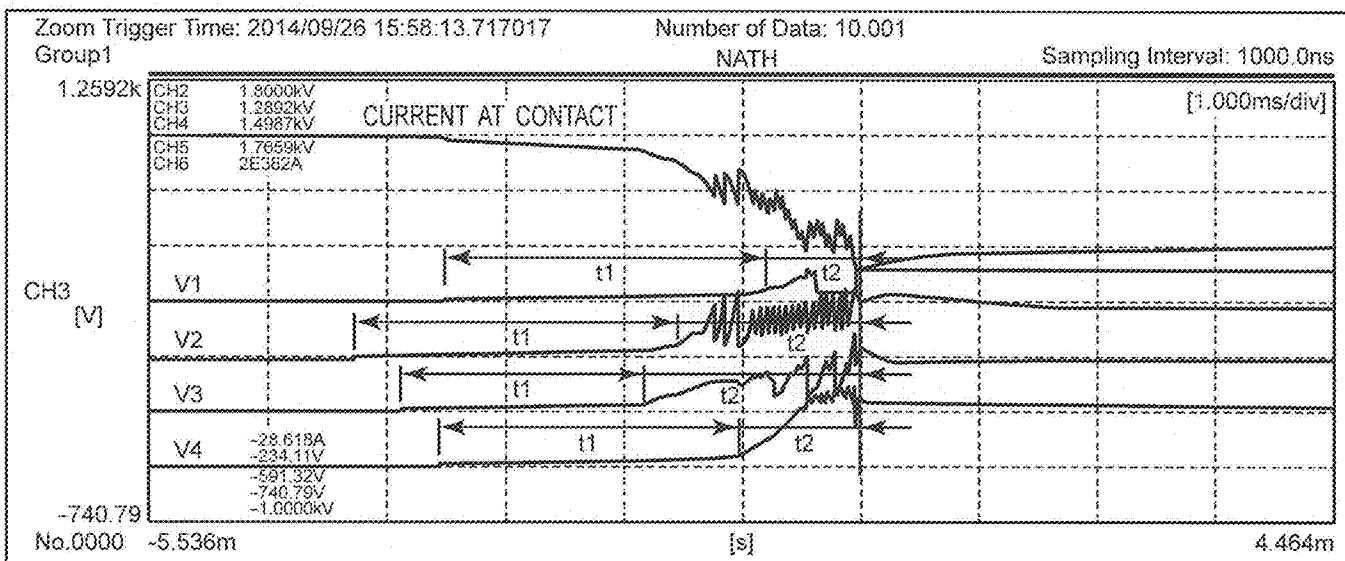

| | FIXED CONTACT | MOVABLE CONTACT | V | B (mH) | d | t1 (ms) | t2 (ms) | t1+t2 (ms) |
|---|---|---|---|---|---|---|---|---|
| ① | 21a | 86a | V1 | 24 | d1 | 2.85 | 0.80 | 3.65 |
| ② | 22a | 86b | V2 | 24 | d2 | 2.75 | 1.55 | 4.30 |
| ③ | 23a | 87a | V3 | 24 | d3 | 2.10 | 1.80 | 3.90 |
| ④ | 24a | 87b | V4 | 24 | d4 | 2.65 | 1.00 | 3.65 |

V VOLTAGE BETWEEN FIXED CONTACT AND MOVABLE CONTACT
B MAGNETIC FLUX DENSITY IN VICINITIES OF CONTACTS AT TIME OF CONTACTING BETWEEN CONTACTS
d SPACING (d1 = d2 = d3 = d4) BETWEEN CONTACTS AT TIME OF SEPARATION OF CONTACTS
t1 TIME FROM GENERATION OF ARC AT TIME OF SEPARATION BETWEEN FIXED CONTACT AND MOVABLE CONTACT TO START OF EXTENSION OF ARC
t2 TIME FROM START OF EXTENSION OF ARC TO COMPLETION OF CUT-OFF OF ARC
t1+t2 ARC CONTINUATION TIME

ELECTROMAGNETIC RELAY

TECHNICAL FIELD

The present invention relates to an electromagnetic relay, and especially to an electromagnetic relay capable of effectively extinguishing a generated arc.

BACKGROUND ART

As a conventional electromagnetic relay, for example, there has been disclosed an electromagnetic relay including: an armature which tilts by excitation and non-excitation of an electromagnetic block; a movable contact portion which has a movable contact, is mounted on the armature, and tilting together with tilting of the armature; and a fixed contact portion having a fixed contact with which the movable contact comes into or cut of contact. In the electromagnetic relay, an arc extension space is formed to extend an arc that is generated when the movable contact comes into or out of contact with the fixed contact, and a magnetic field generation unit is provided to guide, to the arc extension space, an arc that is generated when the movable contact comes into or out of contact with the fixed contact (cf. PTL 1).

In the above electromagnetic relay, as shown in FIGS. 7A and 7B, a fixed contact 22*a* is disposed at an upper surface edge of a base 30, and a movable contact 21*a* is disposed inside the fixed contact 22*a*. The electromagnetic relay is configured such that an arc, generated between the movable contact 21*a* and the fixed contact 22*a*, is attracted upward by magnetic force of a permanent magnet 50 and extended longer, to thereby be eliminated.

CITATION LIST

Patent Literature

PTL 1 Japanese Unexamined Patent Application Publication No. 2013-80692

SUMMARY OF INVENTION

Technical Problem

However, in the above electromagnetic relay, the permanent magnet is disposed each between adjacent fixed contacts so as to extend the arc upward. Since the electromagnetic relay requires an arc extinguishing space having an equivalent size for each pair of the movable contact 21*a* and the fixed contact 22*a*, the apparatus is hard to be reduced in size and has little flexibility in designing, which has been problematic.

In view of the above problem, an object of the present invention is to provide an electromagnetic relay that is easily reduced in size and has great flexibility in designing.

Solution to Problem

An electromagnetic relay according to the present invention, comprises:

a first movable contact and a second movable contact which are disposed on a movable contact piece;

a first fixed contact and a second fixed contact which are disposed so as to contactably and separably face the first movable contact and the second movable contact; and a magnetic field generation unit disposed so as to attract in a predetermined direction an arc generated between the first movable contact and the first fixed contact and an arc generated between the second movable contact and the second fixed contact, wherein, when a predetermined time has passed after generation of an arc at least either between the first movable contact and the first fixed contact or between the second movable contact and the second fixed contact, an arc generated between the first movable contact and the first fixed contact is extended by the magnetic field generation unit to be longer than an arc generated between the second movable contact and the second fixed contact.

Advantageous Effects of Invention

According to the present invention, when a predetermined time has passed after generation of the arc at least either between the first movable contact and the first fixed contact or between the second movable contact and the second fixed contact, the arc generated between the first movable contact and the first fixed contact is cut off by being extended by the magnetic field generation unit to be longer than the arc generated between the second movable contact and the second fixed contact. Hence, there is no need to provide an arc extinguishing space having an equivalent size for each pair of the movable contact and the fixed contact.

For example, the arc generated between the first movable contact and the first fixed contact can be cut off by being attracted and extended long by the magnetic field generation unit to the arc extinguishing space that is a dead space inside the electromagnetic relay. Hence, the arc extinguishing space for extinguishing the arc generated between the second movable contact and the second fixed contact does not need to have an equivalent size to that of the dead space. As a result, it is possible to obtain an electromagnetic relay that is not only easily reduced in size but also has great flexibility in designing.

Another electromagnetic relay according to the present invention, may comprise:

a first movable contact and a second movable contact which are disposed on a movable contact piece;

a first fixed contact and a second fixed contact which are disposed so as to contactably and separably face the first movable contact and the second movable contact; and a magnetic field generation unit disposed so as to attract in a predetermined direction an arc generated between the first movable contact and the first, fixed contact and an arc generated between the second movable contact and the second fixed contact, wherein, a magnetic flux density of the magnetic field generation unit is set such that a magnetic flux density between the first movable contact and the first fixed contact is larger than a magnetic flux density between the second movable contact and the second fixed contact.

According to the present invention, when a predetermined time has passed after generation of the arc between the first movable contact and the first, fixed contact, the arc generated between the first movable contact and the first fixed contact is cut off by being extended by the magnetic field generation unit to be longer than the arc generated between the second movable contact and the second fixed contact. Hence, the arc extinguishing space for extinguishing the arc generated between the second movable contact and the second fixed contact may be small. As a result, even when a resin mold is disposed in the vicinities of the second movable contact and the second fixed contact, the arc is hard to come into contact with the mold, and it is reliably possible to prevent generation of dust and an organic gas.

Another electromagnetic relay according to the present invention, may comprise:

a first movable contact and a second movable contact which are disposed on a movable contact piece;

a first fixed contact and a second fixed contact which are disposed so as to contactably and separably face the first movable contact and the second movable contact; and a magnetic field generation unit disposed so as to attract in a predetermined direction an arc generated between the first movable contact and the first fixed contact and an arc generated between the second movable contact and the second fixed contact, wherein, a contact-to-contact distance between the first movable contact and the first fixed contact at time of contact separation is made larger than a contact-to-contact distance between the second movable contact and the second fixed contact at time of contact separation.

According to the present invention, the first movable contact and the first fixed contact are separated from each other earlier than the second movable contact and the second fixed contact.

That is, the arc between the first movable contact and the first fixed contact is generated earlier than the arc between the second movable contact and the second fixed contact. For this reason, by adjusting a distance between the contacts at the time of separation thereof, the arc generated between the first movable contact and the first fixed contact is extended long and cut off earlier than the arc generated between the second movable contact and the second fixed contact. As a result, the arc extinguishing space for extinguishing the arc generated between the second movable contact and the second fixed contact may be made small. Accordingly, even when the resin mold is disposed in the vicinities of the second movable contact and the second fixed contact, the arc is hard to come into contact with the mold, and it is reliably possible to prevent generation of dust and an organic gas.

As an embodiment of the present invention, a shape of the movable contact piece may be set such that a distance from the movable contact piece to the first fixed contact is larger than a distance from the movable contact piece to the second fixed contact.

According to the present embodiment, the distance between the contacts is adjusted by the shape of the movable contact piece, to enable adjustment of the arc generation time.

As a different embodiment of the present invention, a height dimension of the first fixed contact may be made smaller than a height dimension of the second fixed contact.

According to the present embodiment, the distance between the contacts is adjusted using fixed contacts with different height dimensions, to enable adjustment of the arc generation time.

As a new embodiment of the present invention, a height dimension of the first movable contact may be made smaller than a height dimension of the second movable contact.

According to the present embodiment, the distance between the contacts is adjusted using movable contacts with different height dimensions, to enable adjustment of the arc generation time.

As another embodiment of the present invention, the arc generated between the first movable contact and the first fixed contact may be attracted and extended to an arc extinguishing space that is disposed in a direction that, as seen from the first movable contact or the first fixed contact, is opposite to the facing first fixed contact or the facing first movable contact.

According to the present embodiment, the arc can be extended to a sufficient length by attracting the arc to the arc extinguishing space, thus exerting the effect of reliably cutting off the arc.

BRIEF DESCRIPTION OF DRAWINGS

FIGS. 10A and 103 are a plan view and a bottom view of a base.

FIG. 27 is a graph according to a working example 3 of the present invention.

FIG. 28 is a graph according to a working example 4 of the present invention.

FIG. 29 is a graph according to a comparative example 1.

DESCRIPTION OF EMBODIMENTS

An electromagnetic relay according to the present invention is described in accordance with attached drawings of FIGS. 1A to 31.

Figure 1A:
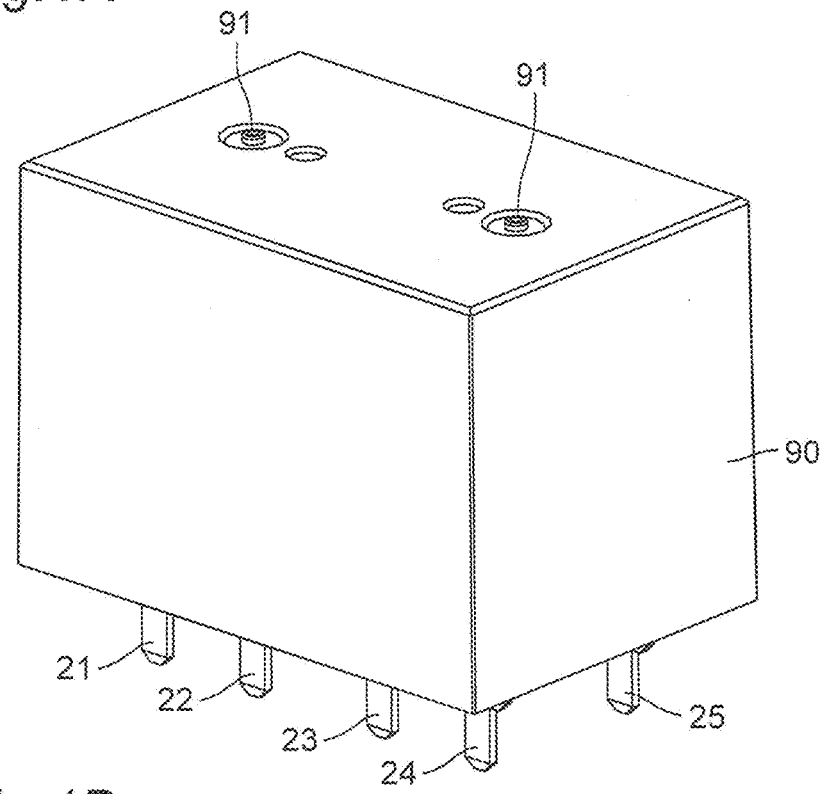
FIGS. 1A and 1B are overall perspective views of an electromagnetic relay according to the present invention, respectively seen from obliquely above and from obliquely below.
Figure 1B:
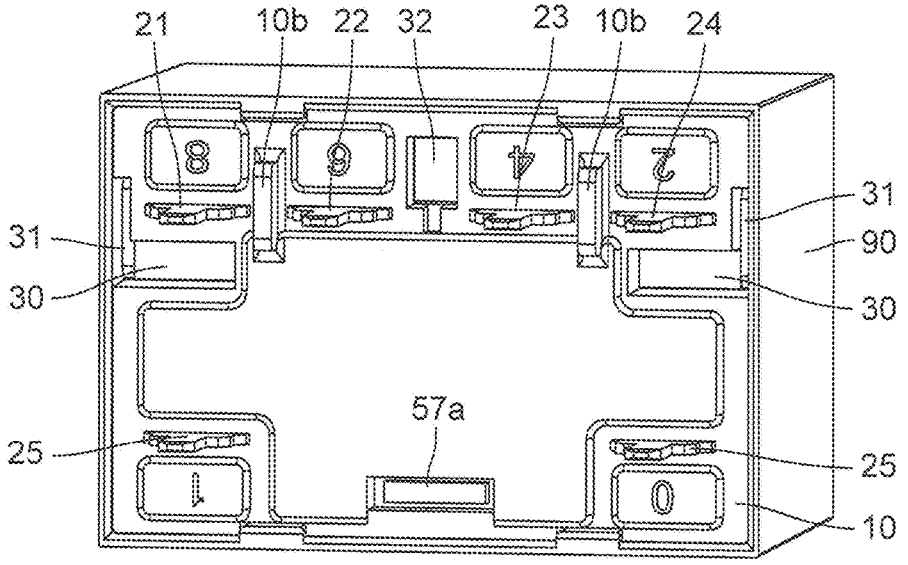
Figure 2A:
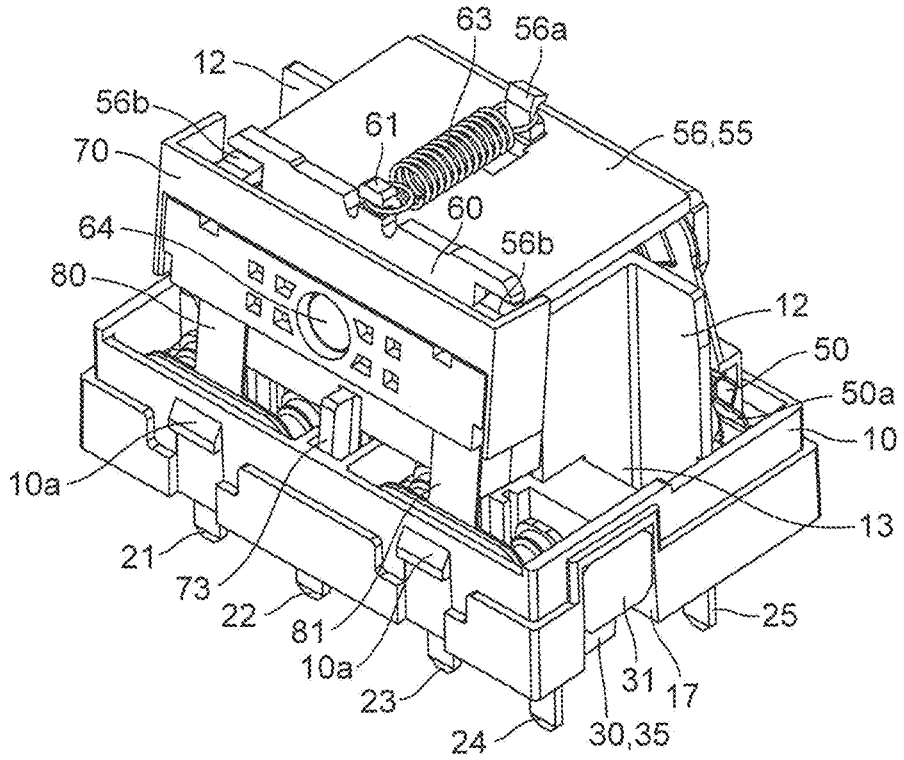
FIGS. 2A and 2B are overall perspective views of the electromagnetic relay according to the present invention with a cover removed therefrom, respectively seen from obliquely above and from obliquely below.
Figure 2B:
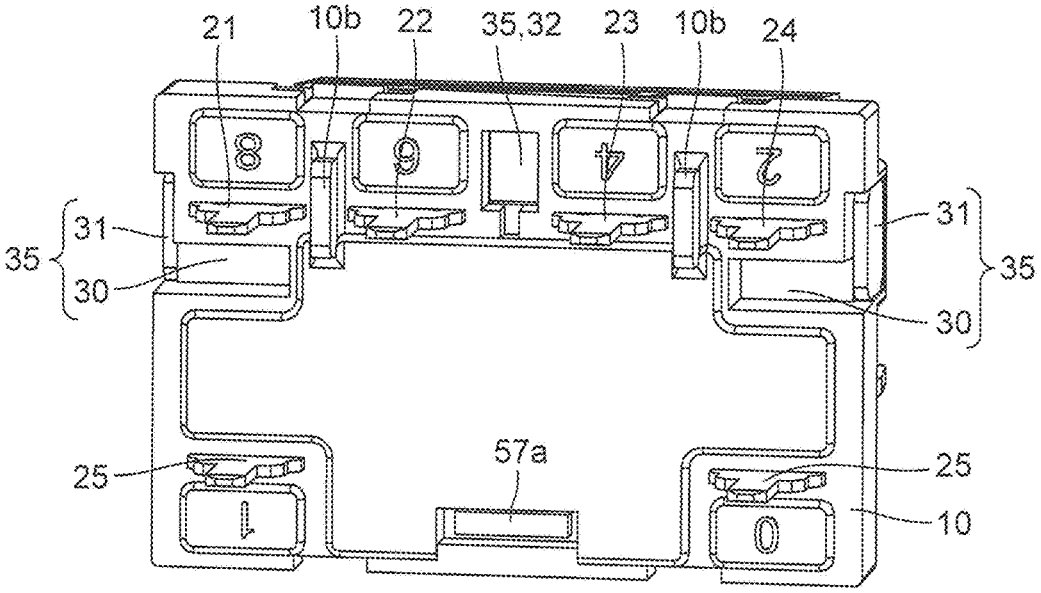
Figure 3:
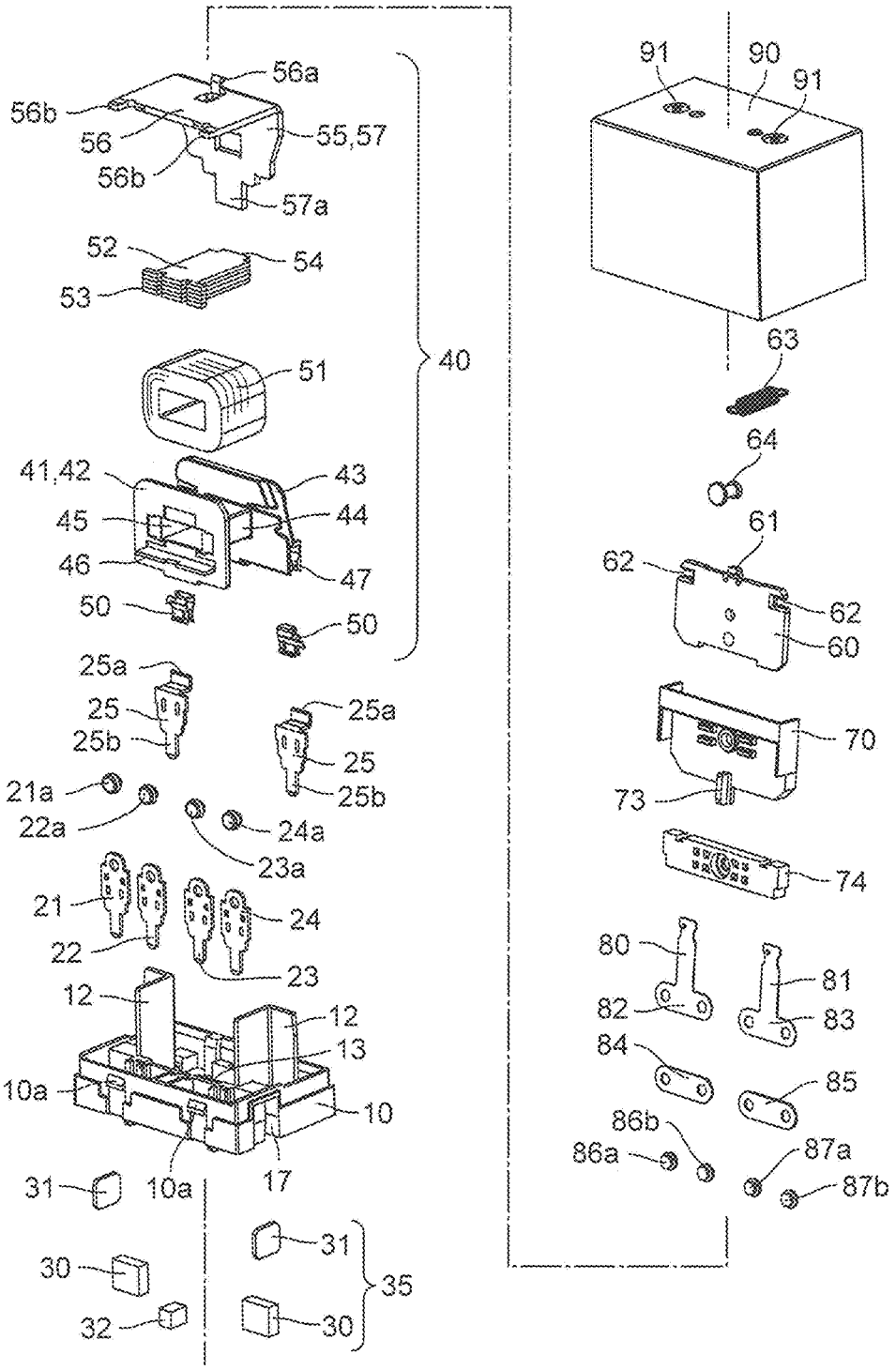
FIG. 3 is an exploded perspective view of the electromagnetic relay shown in FIGS. 1A and 1B, seen from obliquely above.
Figure 4:
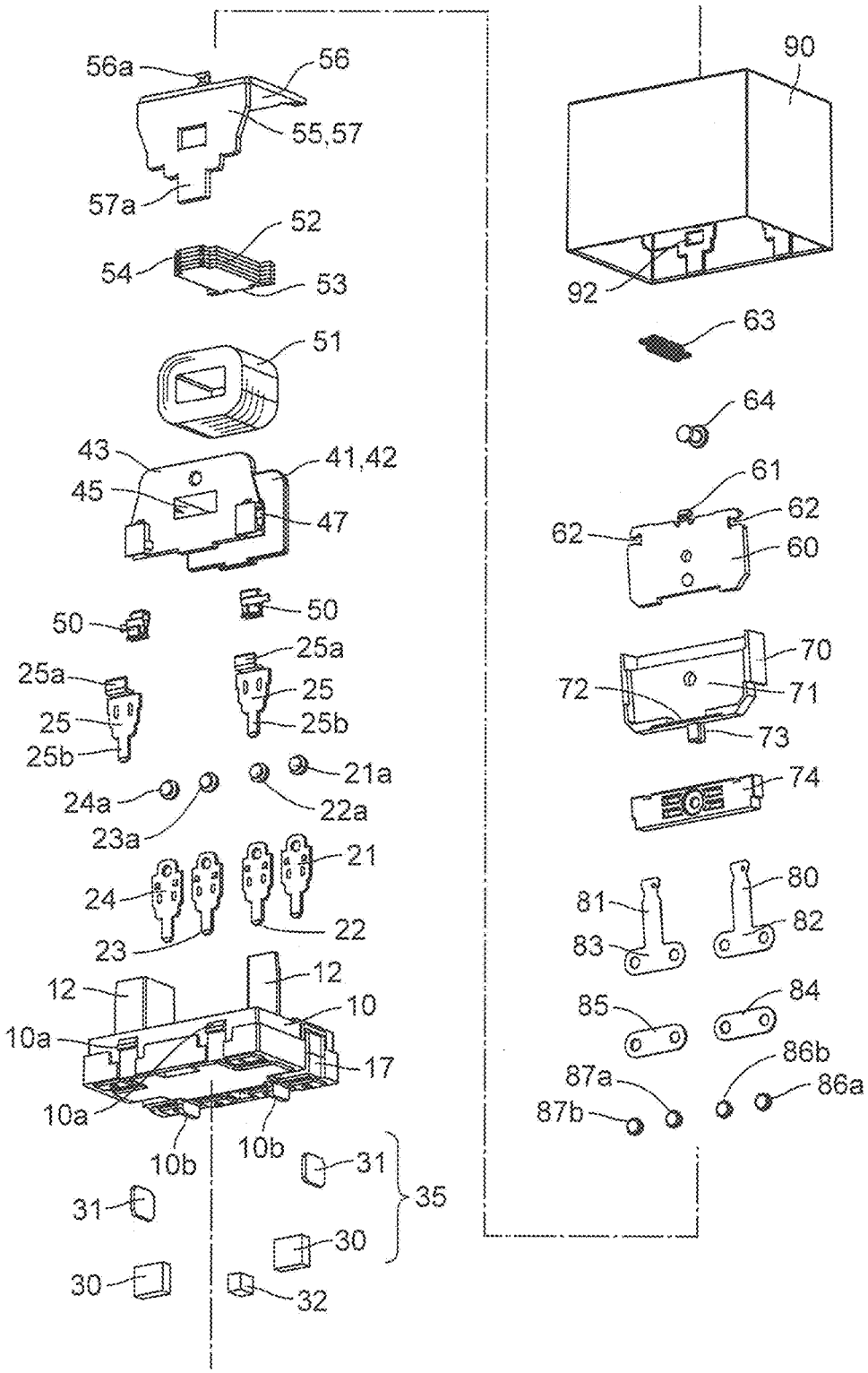
FIG. 4 is an exploded perspective view of the electromagnetic relay shown in FIGS. 1A and 1B, seen from obliquely below.

An electromagnetic relay according to the first embodiment (FIGS. 1A to 2B) are roughly configured of a base 10, fixed contact terminals 21 to 24, a magnetic field generation unit 35, an electromagnetic block 40, a movable iron piece 60, movable contact pieces 80, 81, and a cover 90, as shown in FIGS. 3 and 4.

Figure 10A:
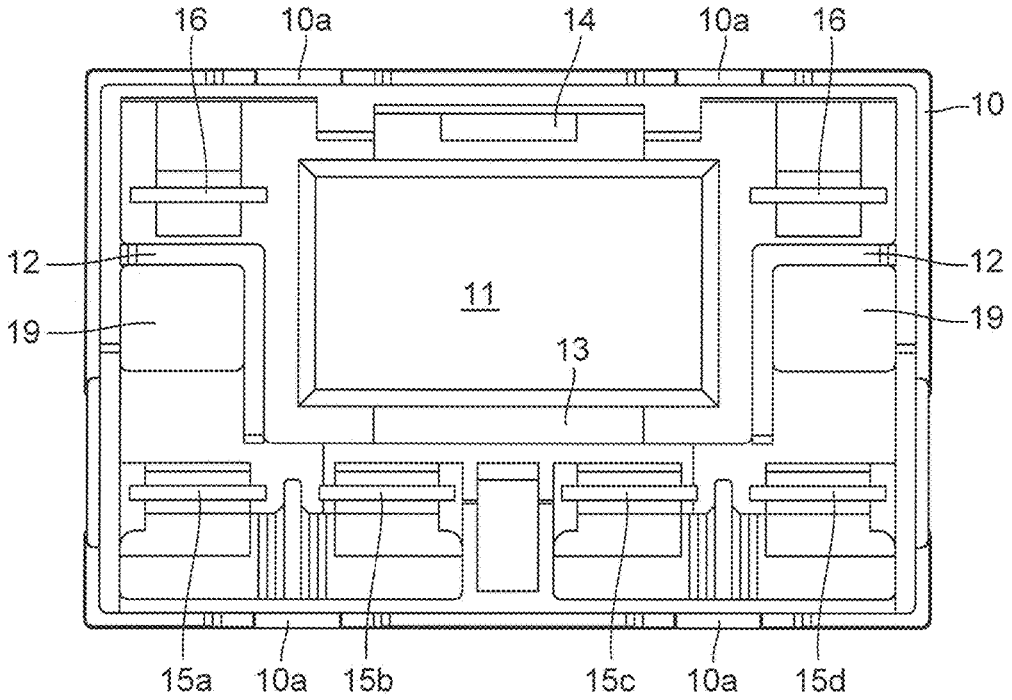

As shown in FIG. 10A, in the base 10, a pair of partition walls 12, 12 having an L-shape in cross section is provided to project from both right and left sides of a recessed portion 11 provided at the center of the upper surface. Further, in the base 10, one edge of edges vertically facing each other with the recessed portion 11 placed therebetween is provided with a stepped portion 13, and the other edge is provided with a press-fitting hole 14. The stepped portion 13 is for supporting a spool 41 of the electromagnetic block 40 described later. The press-fitting hole 14 is for press-fitting the lower end 57*a* of a yoke 55 of the electromagnetic block 40 in. In the base 10, terminal holes 15*a* to 15*d* are provided on the same straight line along one edge of edges facing each other on the upper surface, and terminal holes 16, 16 are provided along the other edge. Then, in the base 10, arc extinguishing spaces 19, 19 are respectively formed between the partition walls 12, 12 and the terminal holes 15*a*, 15*d*. Moreover, in the base 10, a pair of engaging claw portions 10*a* is formed on each of the outer side surfaces facing each other with the partition walls 12, 12 placed therebetween.

According to the present embodiment, there is an advantage that an increase in size of the electromagnetic relay can be avoided by effectively using the dead space of the base 10 as the arc extinguishing space 19.

Figure 10B:
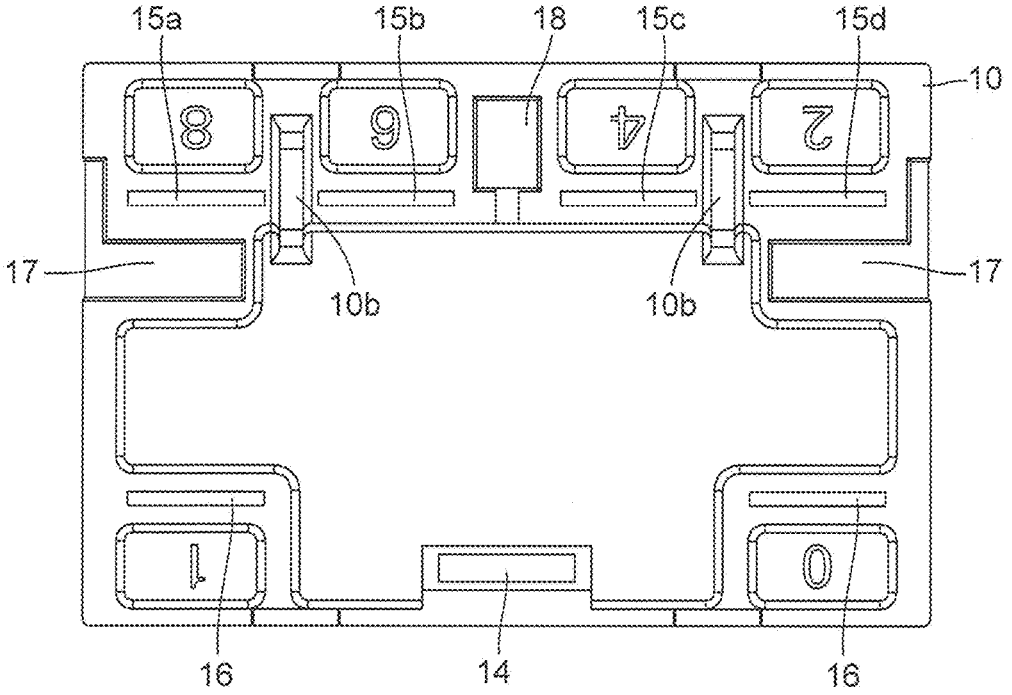

In the lower surface of the base 10, as shown in FIG. 10B, substantially L-shaped notched grooves 17, 17, which are recessed portions, are respectively provided behind the terminal holes 15*a*, 15*d* where the fixed contact terminals 21, 24 are to be inserted (in the direction opposite to a direction in which movable contacts 86*a*, 87*b* described later are installed as seen from the terminal holes 15*a*, 15*d*). Part of the notched groove 17 communicates with the outside from the side surface of the base 10, and is able to house a first permanent magnet 30 and an auxiliary yoke 31 described later. Further, in the base 10, a recessed portion 18 for housing a second permanent magnet 32 described later is provided between the terminal holes 15*b*, 15*c*. Then, in the base 10, a pair of ribs 10*b*, 10*b* is provided to project from the lower surface so as to prevent the electromagnetic relay according to the present invention from being inclined when mounted on a substrate.

Figure 13A:
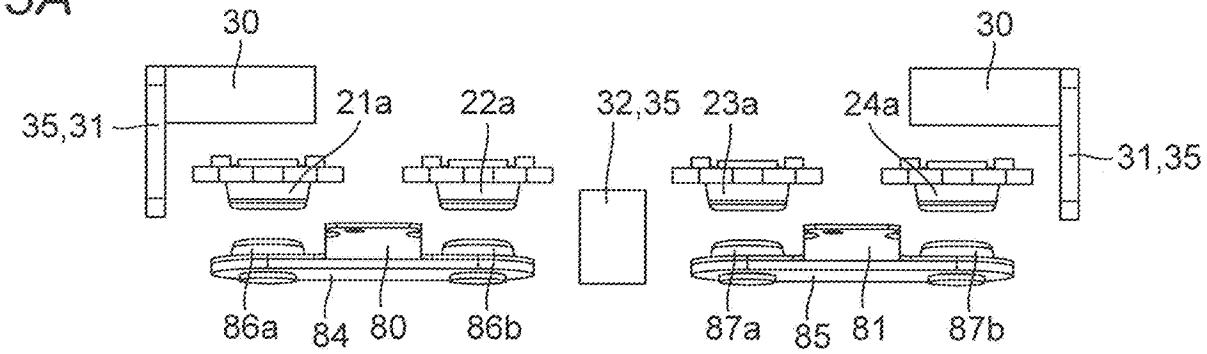
FIGS. 13A and 13B are a schematic plan view and a schematic front view showing a contact mechanism.
Figure 13B:
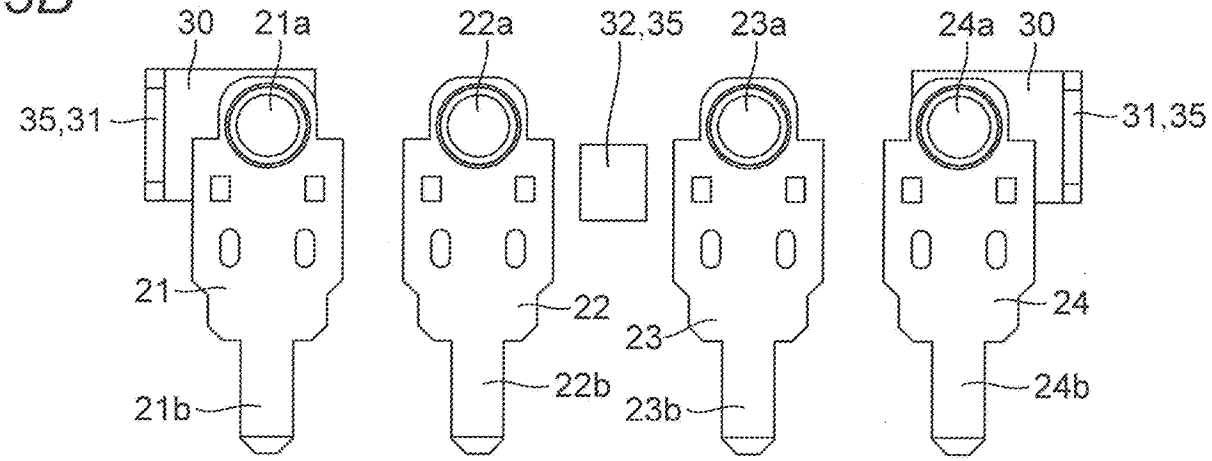
Figure 14A:
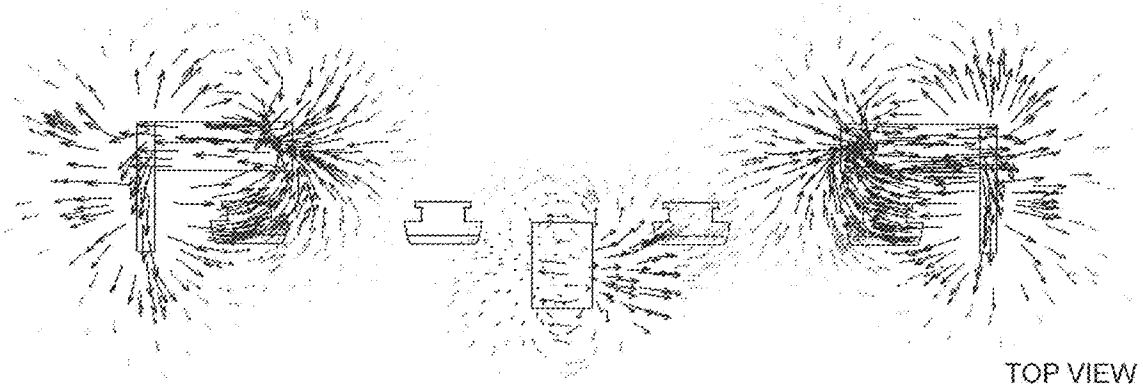
FIGS. 14A and 14B are a plan view and a front view showing, with vector lines, magnetic force lines of permanent magnets of an electromagnetic relay according to a working example 1.
Figure 14B:
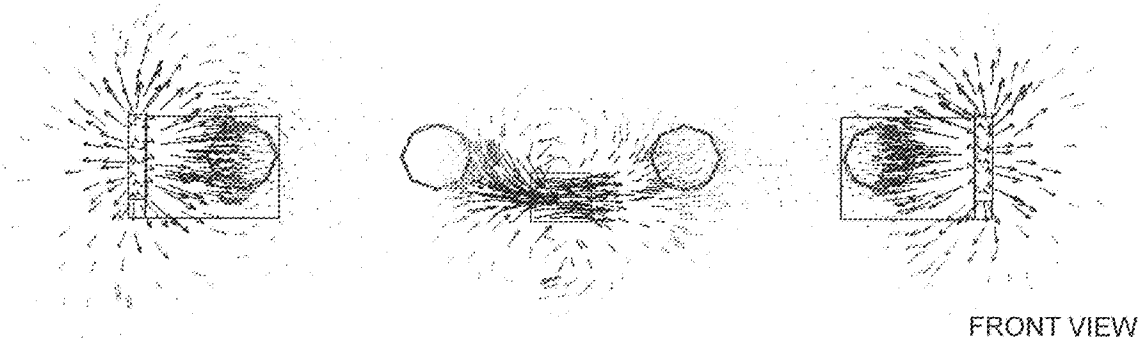

As shown in FIGS. 13A and 13B, the fixed contact terminals 21 to 24 (FIGS. 3 and 4) have the fixed contacts 21*a* to 4*a* fixed to the upper ends thereof, and has terminal portions 21*b* to 24*b* at the lower ends thereof. The terminal portions 21*b* to 24*b* are then inserted into the terminal holes 15*a* to 15*d* (FIGS. 10A and 10B) of the base 10, and the fixed contacts 21*a* to 24*a* are thereby aligned on the same straight line. The four fixed contacts 21*a* to 24*a* are disposed in this manner for the purpose of reducing a load voltage to be applied to each of the four fixed contacts 21*a* to 24*a*. Hence, it is possible to prevent generation of an arc at the time of opening or closing of a DC power supply circuit.

As shown in FIGS. 3 and 4, the coil terminal 25 has a bent connection portion 25*a* on the upper end portion thereof, and has a terminal portion 25*b* on the lower end portion thereof. The terminal portions 25*b* is then pressed into the terminal hole 16 (FIGS. 10A and 103) of the base 10, and the coil terminals 25, 25 are thereby aligned on the same straight line.

As shown in FIGS. 3, 4, 13A, and 13B, the magnetic field generation unit 35 is made up of the first permanent magnet 30, the auxiliary yoke 31, and the second permanent magnet 32. Then, the first permanent magnet 30 is disposed in a direction in which the fixed contacts 21*a*, 24*a* and the movable contacts 86*a*, 87*b* come into or out of contact with each other, namely in the direction opposite to the movable contacts 86*a*, 87*b* as seen from the fixed contacts 21*a*, 24*a* (FIG. 6B). Further, the auxiliary yoke 31 is disposed so as to be adjacent to the first permanent magnet 30. The second permanent magnet 32 (FIG. 7B) is then disposed between the fixed contact 22*a* and the fixed contact 23*a* shown in FIG. 6B.

Directions of magnetic poles of the first permanent magnet 30 and the second permanent magnet 32 are set corresponding to a direction of a current that flows between the fixed contacts 21*a* to 24*a* and the movable contacts 86*a*, 86*b*, 87*a*, 87*b* when fixed contact terminals 22, 23 are electrically connected. Hence, the first permanent magnet 30, the auxiliary yoke 31, and the second permanent magnet 32 can attract arcs respectively generated between the fixed contacts 21*a*, 22*a*, 23*a*, 24*a* and the movable contacts 86*a*, 86*b*, 87*a*, 87*b* in predetermined directions to extend and extinguish the arcs.

In particular, by adjusting the shape or the position of the auxiliary yoke 31, magnetic force lines of the first permanent magnet 30 can be changed in desired directions. It is thus possible to prevent leakage of a magnetic flux of the first permanent magnet 30 in the first permanent magnet 30 while adjusting the arc attracting direction, thereby to enhance the magnetic efficiency.

Figure 6A:
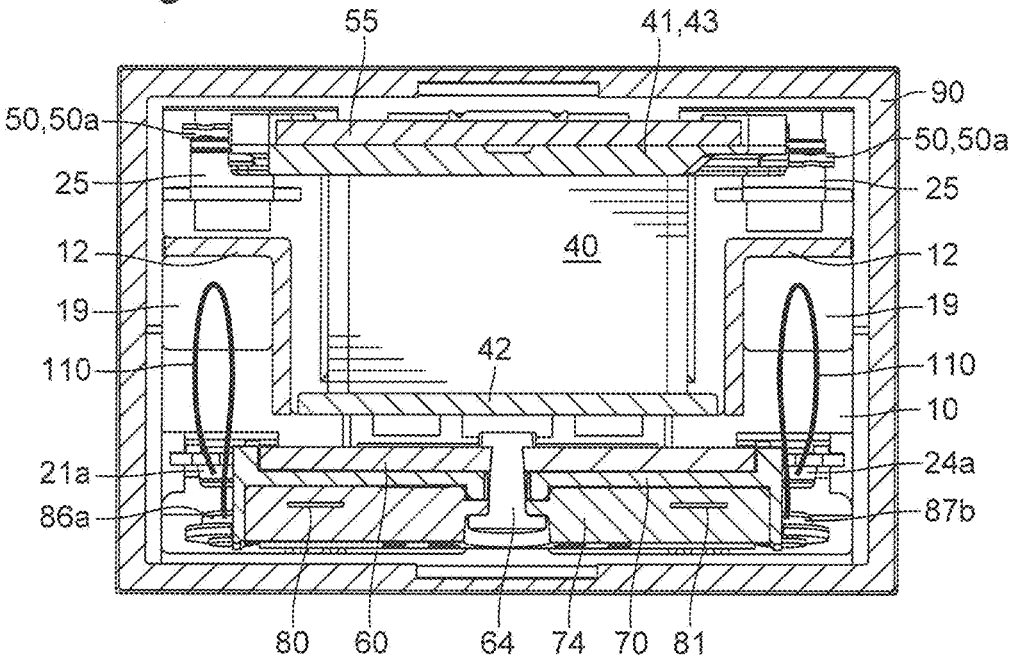
FIGS. 6A and 6B are horizontal sectional views obtained by cutting the electromagnetic relay at different positions.
Figure 6B:
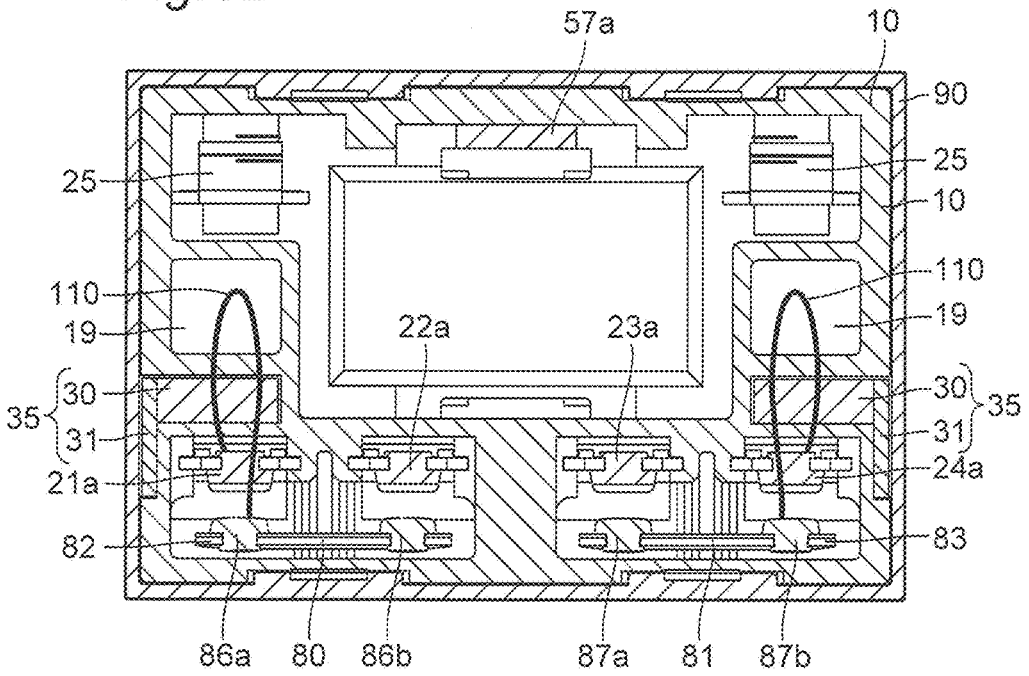

That is, as shown in FIGS. 6A and 6B, the first permanent magnet 30 and the auxiliary yoke 31 are disposed so as to generate magnetic force lines that, can attract the arc generated between the fixed contact 21*a* and the movable contact 86*a* in the direction opposite to the movable contact 86*a* as seen from the fixed contact 21*a*.

Further, the first permanent magnet 30 and the auxiliary yoke 31 are disposed so as to generate magnetic force lines that can attract the arc generated between the fixed contact 24*a* and the movable contact 87*b* in the direction opposite to the movable contact 87*b* as seen from the fixed contact 24*a*.

The second permanent magnet 32 is disposed so as to generate magnetic force lines that can attract the arc generated between the fixed contact 22*a* and the movable contact 86*b* so as to move to the upper surface of the base 10.

Further, the second permanent magnet 32 is disposed so as to generate magnetic force lines that can attract the arc generated between the fixed contact 23*a* and the movable contact 87*a* in the direction opposite to the upper surface of the base 10.

Note that the electromagnetic relay according to the present embodiment has four poles. However, in the present embodiment, the arc generated between the facing fixed contact 22*a* and movable contact 86*b* and the arc generated between the facing fixed contact 23*a* and movable contact 87*a* can be attracted by three permanent magnets in predetermined directions. Hence, there is an advantage that the number of components is smaller than in the conventional case.

In the present embodiment, the description has been given of the configuration where, as shown in FIG. 6B, the generated arc is attracted so as to move obliquely upward in the direction opposite to the movable contact 86*a* and the movable contact 87*b* as seen from the fixed contacts 21*a*, 24*a*. However, this is not restrictive, and the positions of the fixed contact 21*a* and the movable contact 86*a*, or the positions of the fixed contact 24*a* and the movable contact 87*b*, may be reversed. When the positions are reversed in this manner, the directions of magnetic poles of the first permanent magnet 30 and the second permanent magnet 32 can be appropriately set corresponding to the direction of a current that flows between the fixed contacts 21*a*, 22*a*, 23*a*, 24*a* and the movable contacts 86*a*, 86*b*, 87*a*, 87*b* when the fixed contact terminals 22, 23 are electrically connected. It is thus possible to attract the generated arc so as to move obliquely upward in the direction opposite to the fixed contacts 22*a*, 23*a* as seen from the movable contact 86*a* and the movable contact 87*b*.

The first permanent magnet 30 and the auxiliary yoke 31 are inserted into the notched groove 17 (FIGS. 10A and 10B) provided on the base 10. The auxiliary yoke 31 is thereby positioned so as to be adjacent to the first permanent magnet 30. The second permanent magnet 32 is housed into the recessed portion 18 provided in the base 10.

According to the present embodiment, the first and second permanent magnets 30, 32 and the auxiliary yoke 31 are assembled from the lower surface of the base 10. Hence, it is possible to prevent deterioration in the first and second permanent magnets 30, 32 and the auxiliary yoke 31 caused by the generated arc. Further, since the thickness dimension of the base 10 is effectively usable, it is possible to obtain a space-saving electromagnetic relay.

Note that all of the first permanent magnet 30, the auxiliary yoke 31, and the second permanent magnet 32 are not necessarily required to be assembled from the lower surface of the base 10, but may be assembled from the upper surface of the base 10 as needed.

Further, the permanent magnet, or the permanent magnet and the auxiliary yoke, may be disposed behind each of the fixed contacts 21*a* to 24*a*.

Figure 11A:
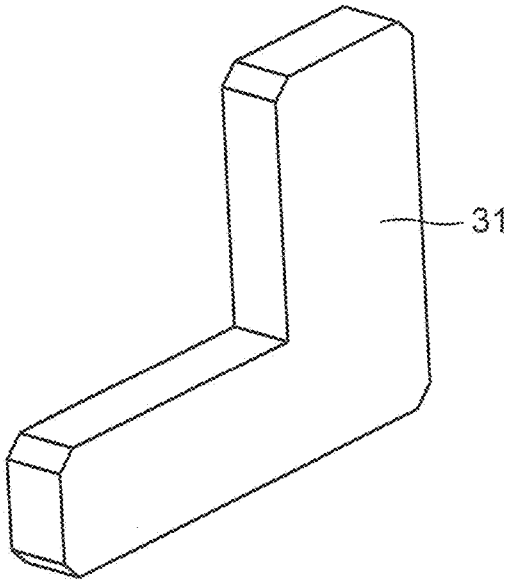
FIGS. 11A and 11B are a perspective view and a right side view showing a modified example of an auxiliary yoke.
Figure 11B:
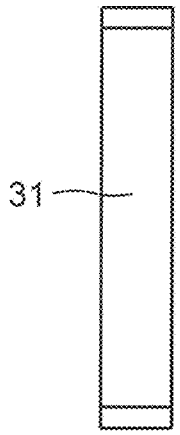

The foregoing auxiliary yoke 31 is net restricted to the rectangular-shaped platy magnetic member, but may, for example, have a substantially L-shape in front view (FIGS. 11A and 11B). According to this modified example, directions of the magnetic force lines of the first, permanent magnet 30 can be changed to directions different from those in the case of using the rectangular-shaped platy magnetic member. Thus, the arc attracting direction can be changed in a desired direction by appropriately adjusting the shape and the position of the auxiliary yoke 31.

Figure 11C:
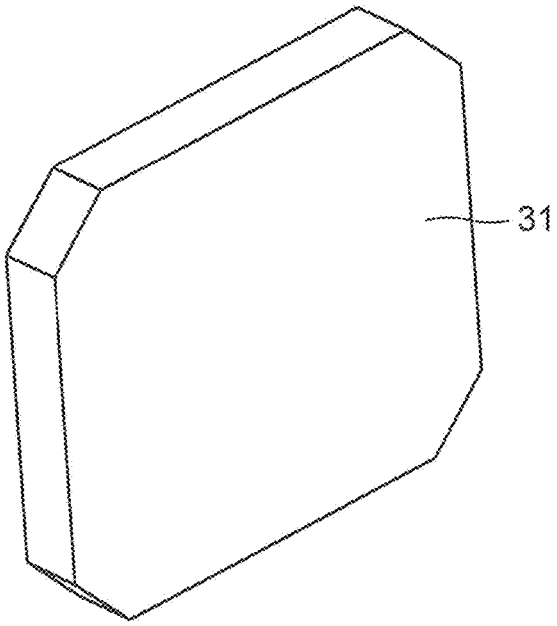
FIGS. 11C and 11D are a perspective view and a right side view showing another modified example of the auxiliary yoke.
Figure 11D:
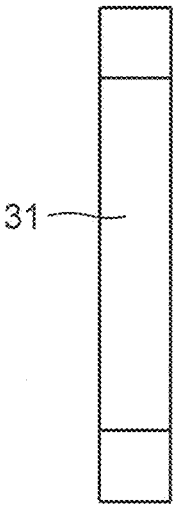

Further, the foregoing auxiliary yoke 31 may be a rectangular platy magnetic member with chamfered corners (FIGS. 11C and 11D). With the corners chamfered, this modified example has the advantage of being more easily inserted into the notched groove 17 and improving the ease of assembly.

Figure 12A:
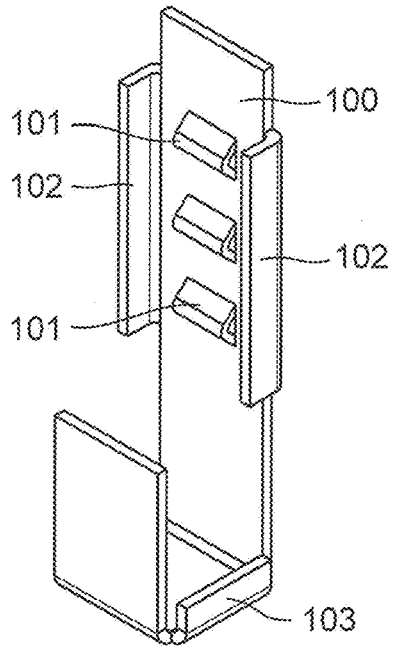
FIGS. 12A and 12B are a perspective view and a longitudinal sectional view showing an arc cut-off member.
Figure 12B:
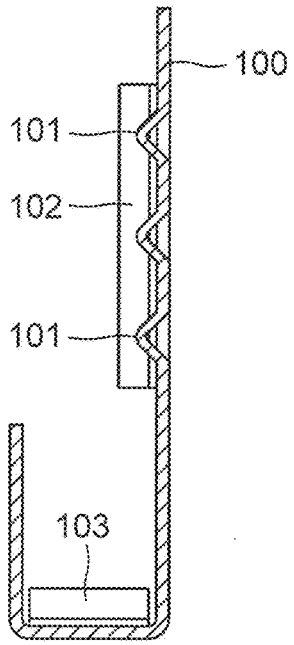

In the arc extinguishing space 19, for example, an arc cut-off member 100 as shown in FIGS. 12A and 12B may be disposed. This is for rapidly cooling the generated arc and effectively extinguishing the arc.

The arc cut-off member 100 is formed by bending a strip metal plate to have a substantially J-shape in cross section. A plurality of projections 101 being substantially triangular in cross section are provided to project from the front surface of arc cut-off member 100. The projections 101 is for expanding a contacting area with the arc to enhance the rapid cooling efficiency. At both-side edges of the front surface of the arc cut-off member 100, ribs 102 are bent and raised so as to face each other. Further, at both-side edges of the bottom surface of the arc cut-off member 100, ribs 103 are bent and raised so as to face each other. The ribs 102, 103 are for preventing leakage of the generated arc from the arc extinguishing space 19.

Figure 12C:
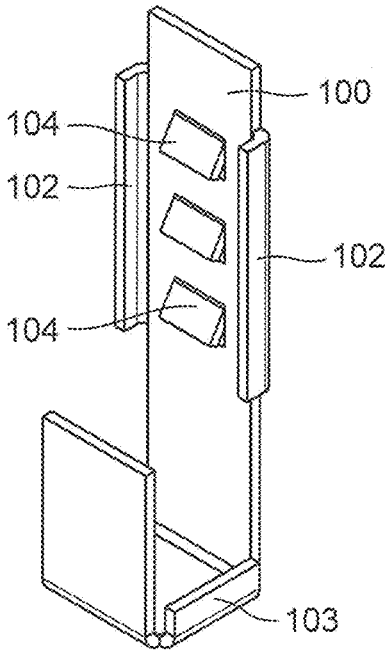
FIGS. 12C and 12D are a perspective view and a longitudinal sectional view showing another modified example of the auxiliary yoke.
Figure 12D:
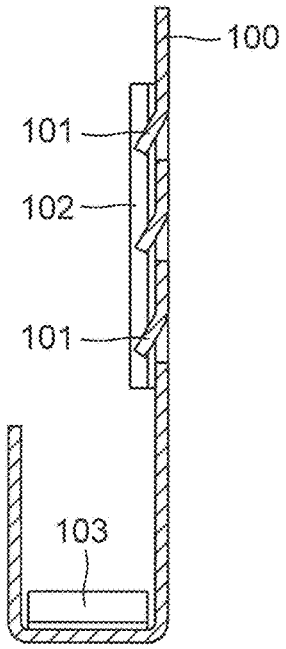

As another arc cut-off member 100, for example as shown in FIGS. 12C and 12D, a plurality of tongue members 104 may be cut and raised on the front surface. Since the others are the same as those of the foregoing arc cut-off member 100, the same portions are provided with the same numerals and descriptions thereof are omitted. Note that the arc cut-off member may simply be made of metal, and is not restricted to the metal plate.

As shown in FIGS. 3 and 4, the electromagnetic block 40 is formed of a spool 41, a coil 51, an iron core 52, and a yoke 55.

Figure 7A:
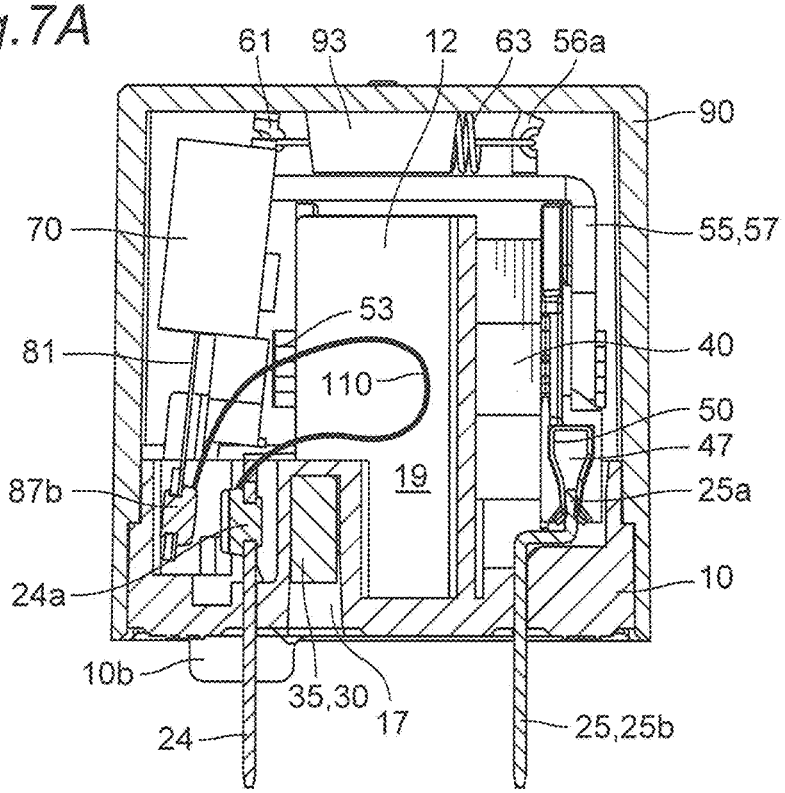
FIGS. 7A and 7B are longitudinal sectional views obtained by cutting the electromagnetic relay at different positions.
Figure 7B:
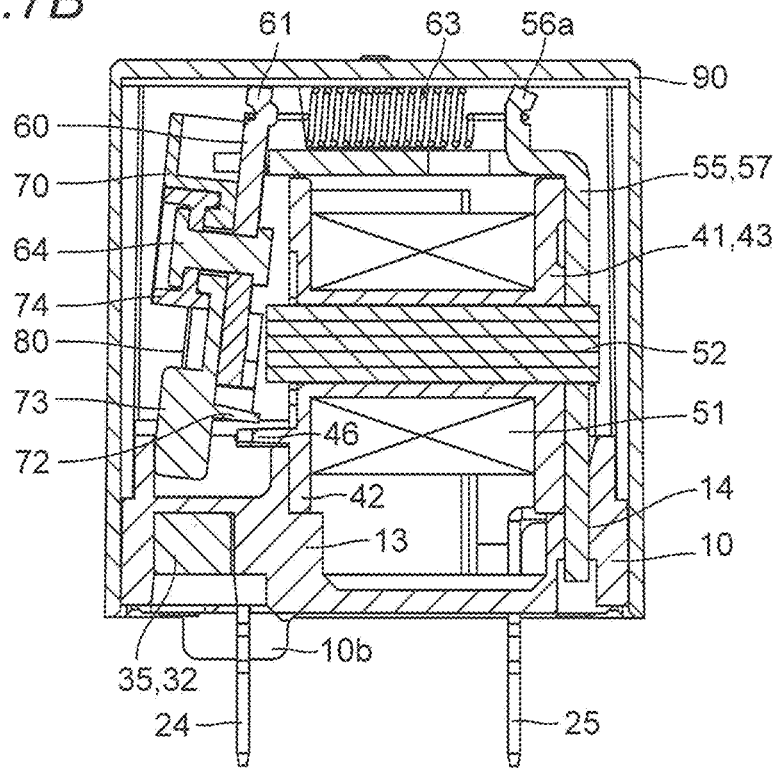

In the spool 41, a through hole 45 being rectangular in cross section is provided in a trunk portion 44 having flange portions 42, 43 at both ends, and an insulating rib 46 is provided to laterally project from the outward surface of one flange portion 42. Further, the removal of the spool 41 is prevented by engaging relay clips 50 into engaging holes 47 provided at both-side edges of the other flange portion 43 (FIG. 7B).

As shown in FIG. 3, the coil 51 is wound around the trunk portion 44, and a leader line of the coil 51 is bound and soldered to a binding portion 50*a* (FIG. 6A) extending from the relay clip 50

As shown in FIG. 3, the iron core 52 is formed by laminating a plurality of platy magnetic members having a substantially T-shape in planar view. The iron core 52 is then put through the through hole 45 of the spool 41. One protruding end of the iron core 52 is taken as a magnetic pole portion 53, and the other protruding end 54 is crimped and fixed to a vertical portion 57 of the yoke 55 having a substantially L-shape in cross section which is described later.

The yoke 55 is made of a magnetic plate that is bent to have a substantially L-shape in cross section. In the yoke 55, an engaging projection 56*a* is bent and raised at the center of a horizontal portion 56, and supporting projections 56*b* are cut and raised at both-side edges of the tip of the horizontal portion 56. Further, the yoke 55 is formed in such a shape that the lower end 57*a* of the vertical portion 57 can be press-fitted into the press-fitting hole 14 of the base 10.

The movable iron piece 60 is made of a platy magnetic member. As shown in FIGS. 3 and 4, in the movable iron piece 60, an engaging projection 61 is provided to project from the upper-side edge, and notched portions 62, 62 are provided at both-side edges.

In the movable iron piece 60, the notched portion 62 is engaged to the supporting projections 56*b* of the yoke 55. Further, the movable iron piece 60 is rotatably supported by coupling the engaging projection 61 to the engaging projection 56*a* of the yoke 55 via a restoring spring 63.

The movable contact pieces 30, 81 each have a substantially T-shape in front view, and the movable contacts 86*a*, 86*b*, 87*a*, 87*b* are fixed at both ends of large width portions 82, 83 of the movable contact pieces 80, 81 via conductive lining members 84, 85. The lining members 84, 85 substantially increase sectional areas of the large width portions 82, 83 to reduce electric resistance and suppress heat generation. Further, as described above, the arc is attracted so as to move obliquely upward in the direction opposite to the movable contact 86*a* and the movable contact 87*b*, as seen from the fixed contacts 21*a*, 24*a*. Accordingly, the generated arc is hard to come into contact with the movable contact pieces 80, 81 themselves, and it is thus possible to prevent deterioration in the movable contact pieces 80, 81 caused by the arc.

The movable contact pieces 80, 81 are integrally formed by insert-molding of the top ends thereof with a movable stage 74. Then, as shown in FIG. 7B, the movable stage 74 is integrally formed with a spacer 70 and the movable iron piece 60 via a rivet 64. As shown in FIG. 4, the spacer 70 enhances insulating properties of the movable iron piece 60 by fitting of the movable iron piece 60 into a recessed portion 71 provided on the inward surface of the spacer 70. In the spacer 70, an insulating rib 72 (FIGS. 3 and 7B) is provided at the lower-side edge of the inward surface, and an insulating rib 73 (FIGS. 3 and 7E) for separating the movable contact pieces 80, 81 is provided to laterally project from the lower-side edge of the outward surface.

Figure 8A:
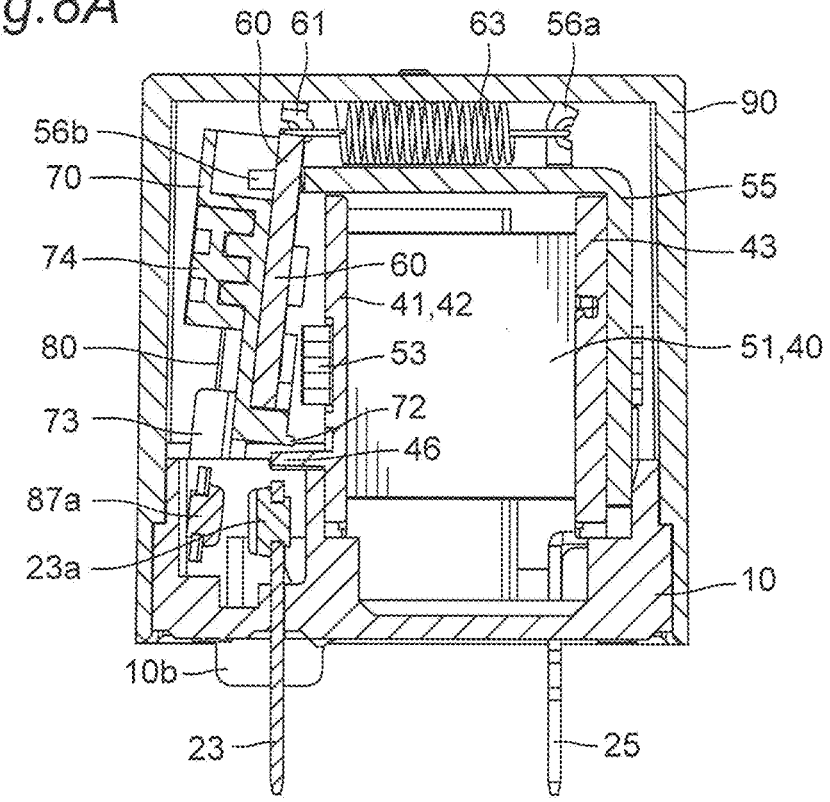
FIGS. 8A and 8B are a longitudinal sectional view and a partially enlarged longitudinal sectional view of the electromagnetic relay.
Figure 8B:
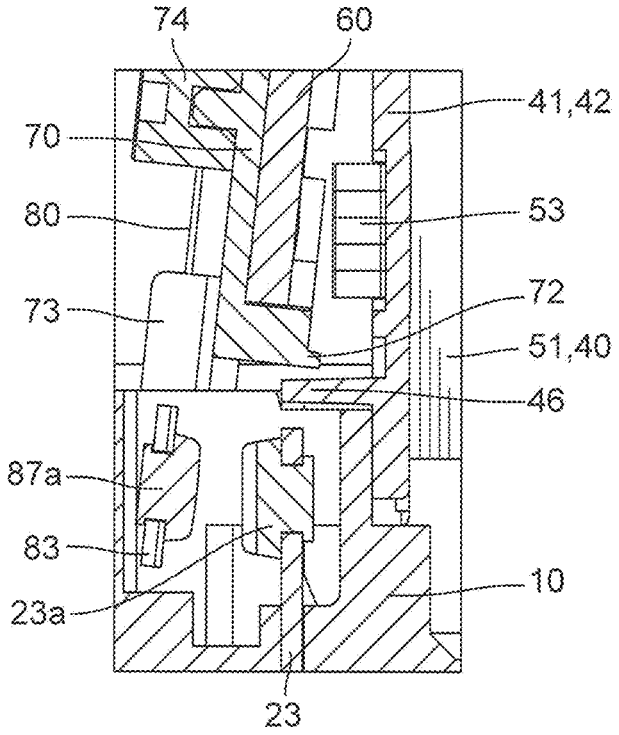

Then, the electromagnetic block 40 mounted with the movable contact pieces 80, 81 is housed into the base 10, and a flange portion 42 of the spool 41 is placed on the stepped portion 13 (FIG. 7B) of the base 10. Then, the lower end 57*a* of the yoke 55 is press-fitted into the press-fitting hole 14 of the base 10 and positioned. Accordingly, the relay clips 50 of the electromagnetic block 40 pinch a connection portion 25*a* of the coil terminal 25 (FIG. 7A). Further, the movable contacts 86*a*, 86*b*, 87*a*, 87*b* contactably and separably face the fixed contacts 21*a*, 22*a*, 23*a*, 24*a*, respectively. As shown in FIG. 8B, the insulating rib 72 of the spacer 70 is located in the upper vicinity of the insulating rib 46 of the spool 41.

Specifically, at least either the insulating rib 46 or 72 is disposed so as to cut off the shortest-distance straight line connecting between each of the fixed contacts 22*a*, 23*a* (or the fixed contact terminals 22, 23) and the magnetic pole portion 53. This leads to an increase in spatial distance from the magnetic pole portion 53 of the iron core 52 to each of the fixed contacts 22*a*, 23*a*, and high insulating properties can thus be obtained.

Further, the insulating rib 72 may be disposed so as to cut off the shortest-distance straight line connecting between the tip edge of the insulating rib 46 and the magnetic pole portion 53. This can lead to an increase in spatial distance from the magnetic pole portion 53 of the iron core 52 to each of the fixed contacts 22*a*, 23*a*, and higher insulating properties can thus be obtained.

Note that a length dimension of the insulating rib 46 projecting from the outward surface of the flange portion 42 is preferably a length dimension that is smaller than a distance from the outward surface of the flange portion 42 to the tip of each of the fixed contacts 22*a*, 23*a*. This is because, if the length dimension of the insulating rib 46 is a length dimension that is larger than the distance from the outward surface of the flange portion 42 to the tip of each of the fixed contacts 22*a*, 23*a*, operation of the movable contact pieces 80, 81 might be hindered. As another reason, the arcs respectively generated between the fixed contacts 22*a*, 23*a* and the movable contacts 86*b*, 87*a* are more likely to hit against the insulating rib 72, causing the insulating rib 72 to easily deteriorate. Accordingly, a more preferable length dimension of the insulating rib 46 is a length dimension from the outward surface of the flange portion 42 to the outward surface of each of the fixed contact terminals 22, 23.

As shown in FIGS. 3 and 4, the cover 90 has a box shape that can be fitted to the base 10 with the electromagnetic block 40 assembled therein. A pair of gas releasing holes 91, 91 is provided on the ceiling surface of the cover 90. Further, in the cover 90, engagement receiving portions 92 to be engaged with the engaging claw portions 10*a* of the base 10 are provided on the facing inner side surface, and position regulation ribs 93 (FIG. 5B) are provided to project from the ceiling inner surface.

Figure 5A:
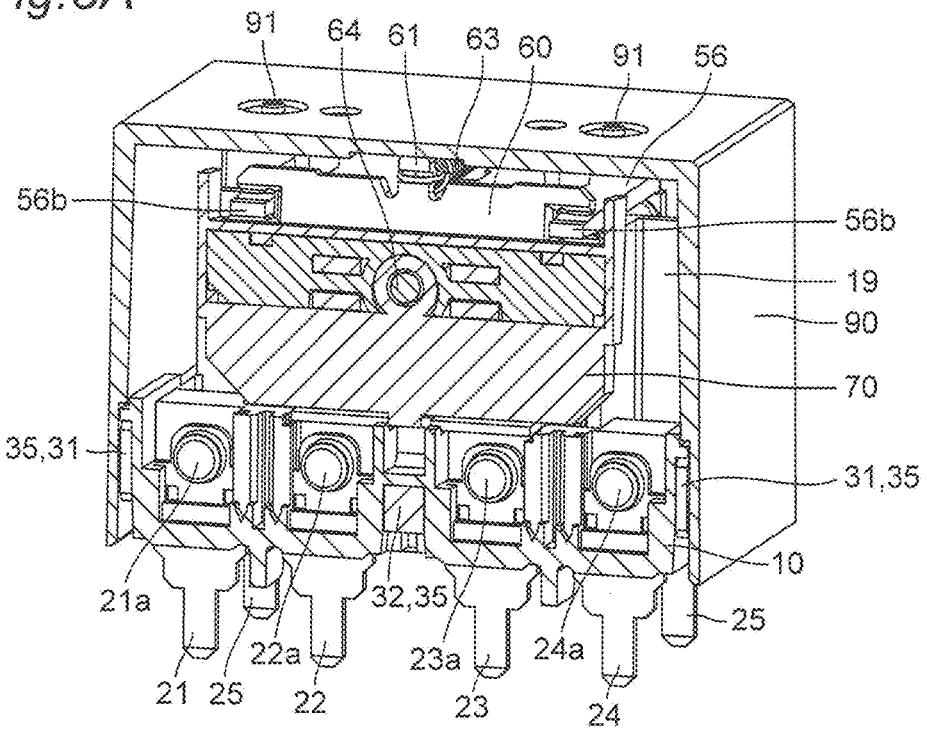
FIGS. 5A and 5B are lateral sectional views obtained by cutting the electromagnetic relay at different positions.
Figure 5B:
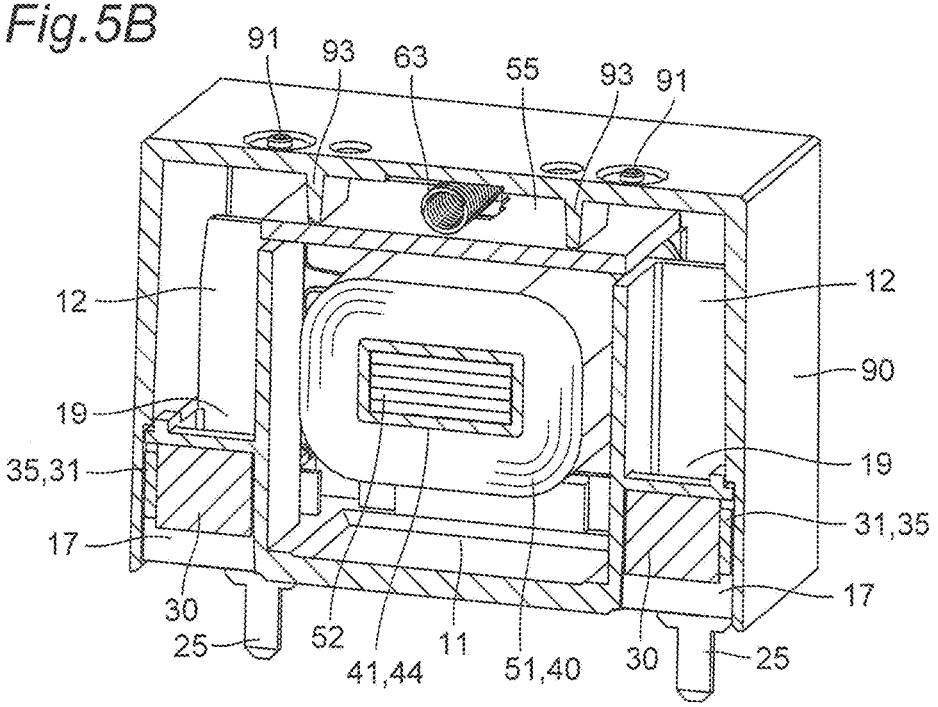

Thus, when the cover 90 is fitted to the base 10 with the electromagnetic block 40 assembled therein, the engagement receiving portion 92 of the cover 90 is engaged and fixed to the engaging claw portion 10*a* of the base 10. The position regulation ribs 93 then come into contact with the horizontal portion 56 of the yoke 55 to regulate lifting of the electromagnetic block 40 (FIG. 5B). Next, by hermetically sealing the base 10 and the cover 90 by injecting and solidifying a sealing material (not shown in the drawing) on a lower surface of the base 10, an assembling operation is completed.

In the present embodiment, the sealing material is injected to enable the first and second permanent magnets 30, 32 and the auxiliary yoke 31 to be fixed onto the base 10, while simultaneously sealing a gap between the base 10 and the cover 90. Thus, according to the present embodiment, it is possible to obtain an electromagnetic relay taking a small number of operation steps and having high productivity.

Next, the operation of the above embodiment is described.

When the electromagnetic block 40 is not excited, as shown in FIGS. 7A to 8B, the movable iron piece 60 is biased clockwise by the spring force of the restoring spring 63. Hence, the movable contacts 36*a*, 86*b*, 87*a*, 87*b* are respectively separated from the fixed contacts 21*a*, 22*a*, 23*a*, 24*a*.

Figure 9A:
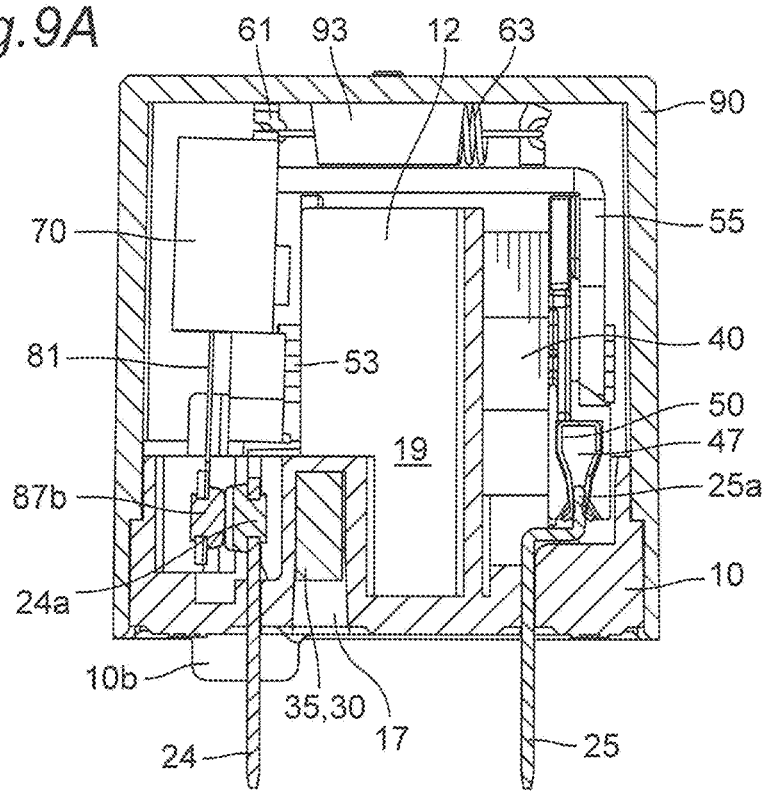
FIGS. 9A and 9B are longitudinal sectional views obtained by cutting the electromagnetic relay at different positions after operation.
Figure 9B:
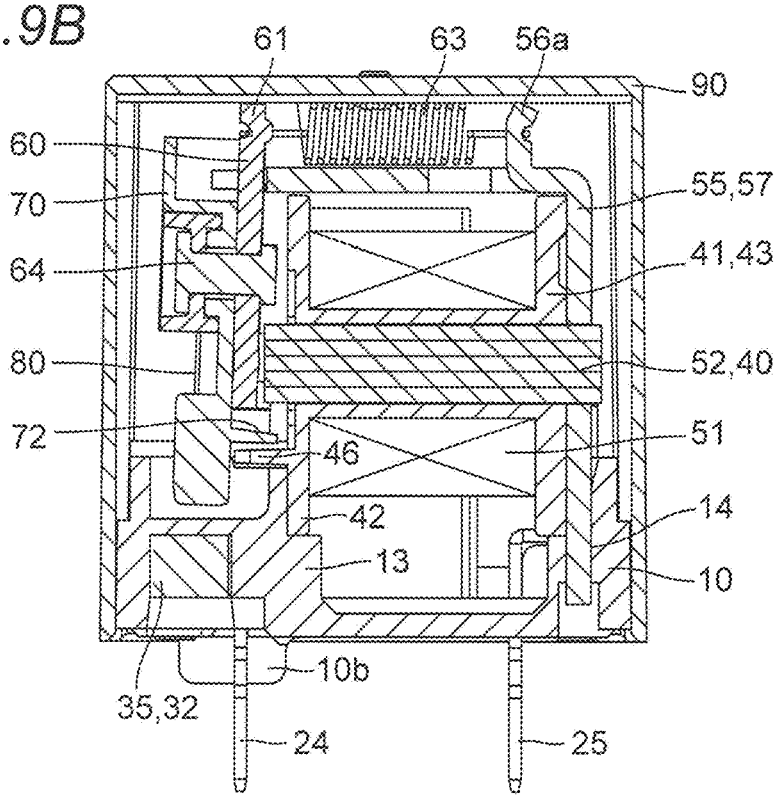

When a voltage is applied to the coil 51 for excitation, the movable iron piece 60 is attracted to the magnetic pole portion 53 of the iron core 52, and the movable iron piece 60 rotates clockwise against the spring force of the restoring spring 63. For this reason, the movable contact pieces 80, 81 rotate together with the movable iron piece 60, and the movable contacts 86*a*, 86*b*, 87*a*, 87*b* respectively come into contact with the fixed contacts 21*a*, 22*a*, 23*a*, 24*a*. Thereafter, the movable iron piece 60 is attracted to the magnetic pole portion 53 of the iron core 52 (FIGS. 9A and 9B).

Subsequently, when the application of the voltage to the coil 51 is stopped, the movable iron piece 60 rotates clockwise by the spring force of the restoring spring 63, and the movable iron piece 60 is separated from the magnetic pole portion 53 of the iron core 52. Thereafter, the movable contacts 86*a*, 86*b*, 87*a*, 87*b* are respectively separated from the fixed contacts 21*a*, 22*a*, 23*a*, 24*a* to return to the original state.

According to the present embodiment, as shown in FIGS. 6A to 7B, even when an arc 110 is generated at the time of separation of the movable contacts 86*a*, 87*b* from the fixed contacts 21*a*, 24*a*, the magnetic force lines of the first permanent magnet 30 can act on the arc 110 via the auxiliary yoke 31. Thus, based on the Fleming's left hand rule, the generated arc 110 is attracted by the Lorentz force to the arc extinguishing space 19 of the base 10, to be extended and extinguished.

According to the present embodiment, the arc 110 can be attracted to the oblique backward of the fixed contacts 21*a*, 24*a* and extinguished only by the first permanent magnet 30. The oblique backward of the fixed contacts 21*a*, 24*a* here means a direction that, as seen from the fixed contacts 21*a*, 24*a*, is opposite to the facing movable contacts 86*a*, 87*b*, and in the direction opposite to the base.

Further, by disposing the auxiliary yoke 31, the arc 110 can be attracted in a right and left direction, to adjust the attracting direction. The right and left direction of the arc 110 means a direction vertical to a direction in which the fixed contacts 21*a*, 24*a* and the movable contacts 36*a*, 87*b* face each other, as well as a direction parallel to the upper surface of the base.

Thus, according to the present embodiment, the generated arc 110 does not come into contact with the inner surface of the cover 90 and the electromagnetic block 40, to thereby be extended obliquely backward in an appropriate direction. This enables more effective extinguish of the arc 110.

According to the present embodiment, there is an advantage that an increase in size of the apparatus can be avoided since the dead space located behind each of the fixed contacts 21*a*, 24*a* is effectively used as the arc extinguishing space 19.

Needless to say, the shapes, sizes, materials, disposition, and the like of the first and second permanent magnets 30, 32 and the auxiliary yoke 31 are not restricted to those described above, but can be changed as necessary.

Working Example 1

A working example 1 is an analysis of directions and strength of the magnetic force lines in the case of combining the first and second permanent magnets 30, 32 with the auxiliary yoke 31.

Figure 15A:
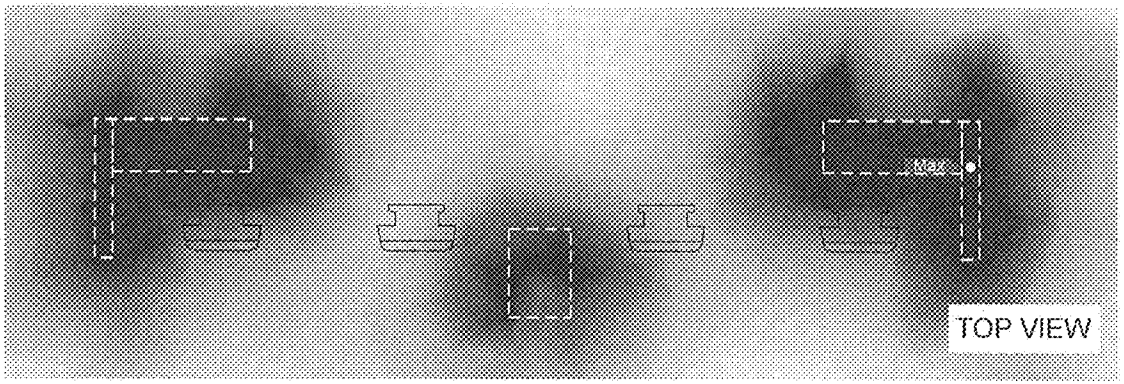
FIGS. 15A and 15B are a plan view and a front view showing, with concentration, magnetic flux densities of the permanent, magnets of the electromagnetic relay according to the working example 1.
Figure 15B:
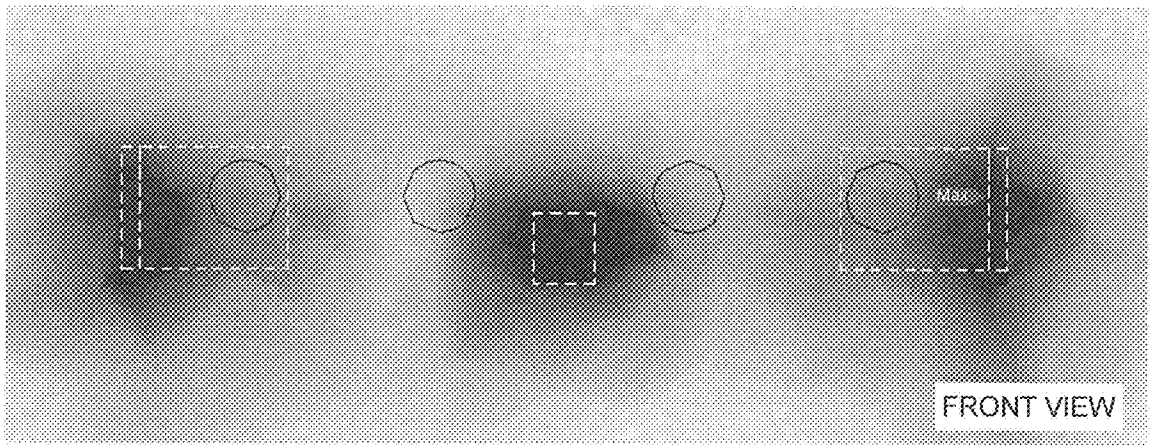
Figure 16A:
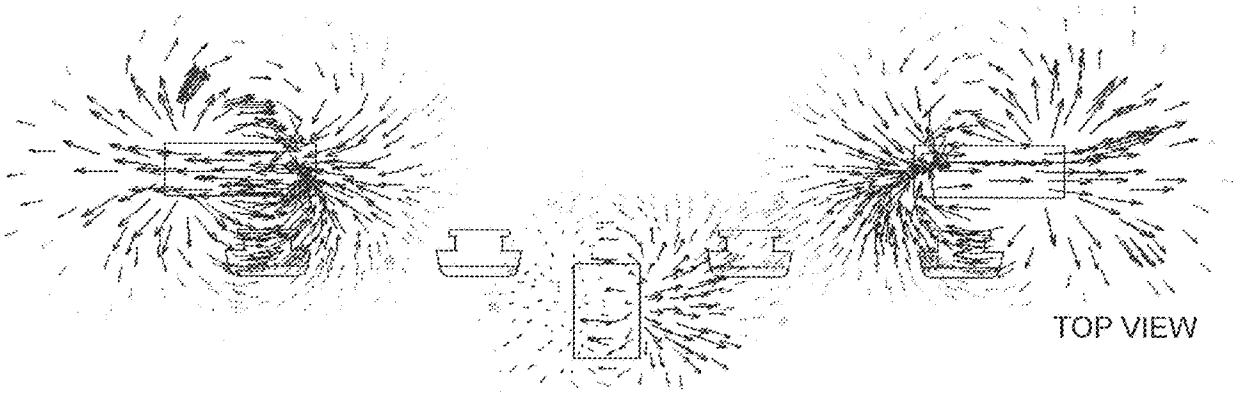
FIGS. 16A and 16B are a plan view and a front view showing, with vector lines, magnetic force lines of permanent magnets of an electromagnetic relay according to a working example 2.
Figure 16B:
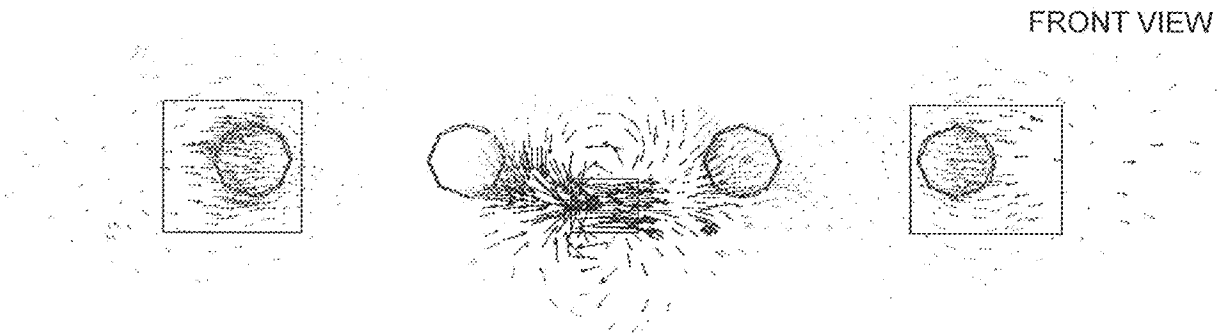

As an analysis result, the directions of the magnetic force lines are shown by vector lines (FIGS. 14A and 14B), and the strength of the magnetic force lines is shown by concentration (FIGS. 15A and 15B).

Working Example 2

A working example 2 is an analysis of directions and strength of the magnetic force lines in the case of disposing the components in the same manner as in the working example 1 described above except for not providing the auxiliary yoke 31.

Figure 17A:
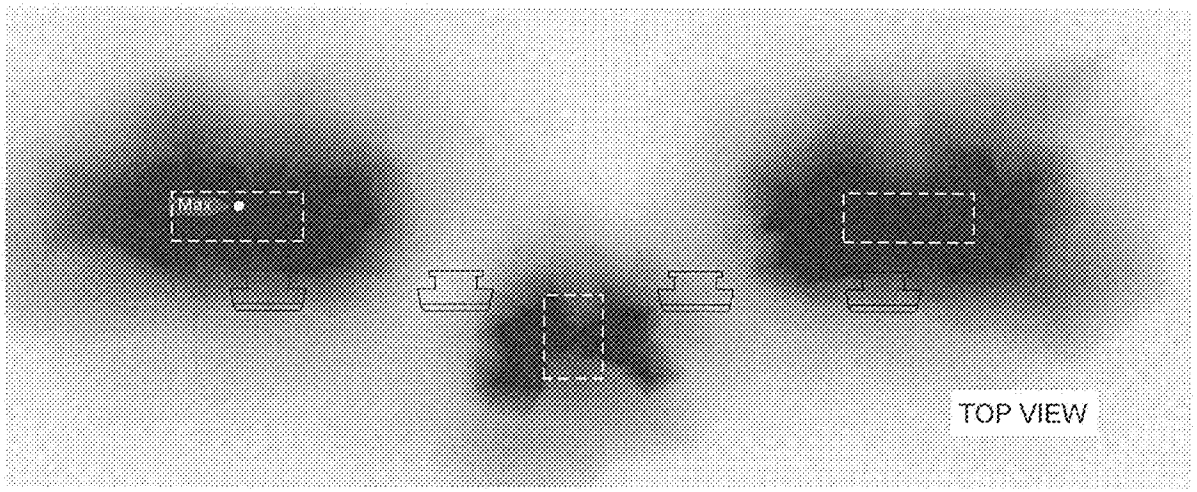
FIGS. 17A and 17B are a plan view and a front view showing, with concentration, magnetic flux densities of the permanent magnets of the electromagnetic relay according to the working example 2.
Figure 17B:
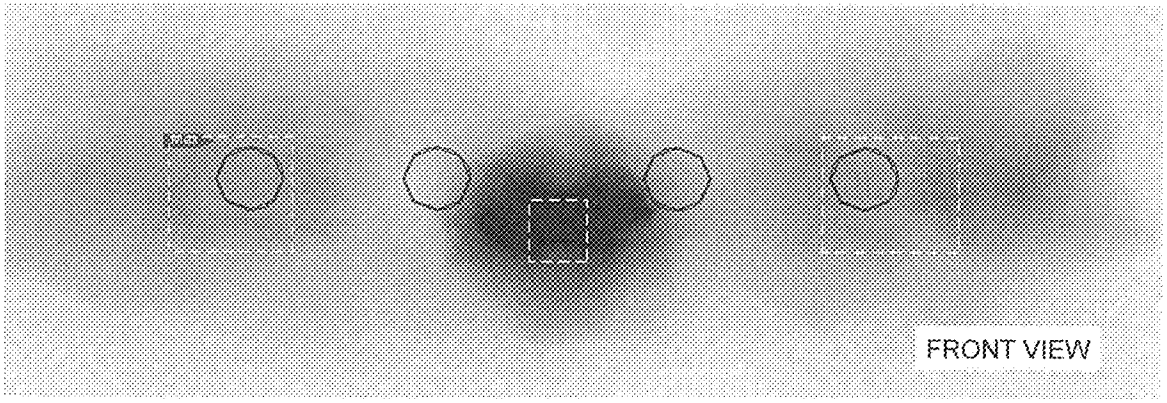

As an analysis result, the directions of the magnetic force lines are shown by vector lines (FIGS. 16A and 16B), and the strength of the magnetic force lines is shown by concentration (FIGS. 17A and 17B).

It could be confirmed from FIGS. 14A to 15R as to how and to what extent the magnetic force lines of the first and second permanent magnets 30, 32 act on the fixed contacts 21*a*, 22*a*, 23*a*, 24*a* and the movable contacts 86*a*, 86*b*, 87*a*, 87*b*.

Further, it could be confirmed, by comparing the results described in FIGS. 14A to 15B with the results described in FIGS. 16A to 17B, that provision of the auxiliary yoke 31 leads to changes in directions of the magnetic force lines of the permanent magnets and distribution of the strength of the magnetic force lines.

Figure 18:
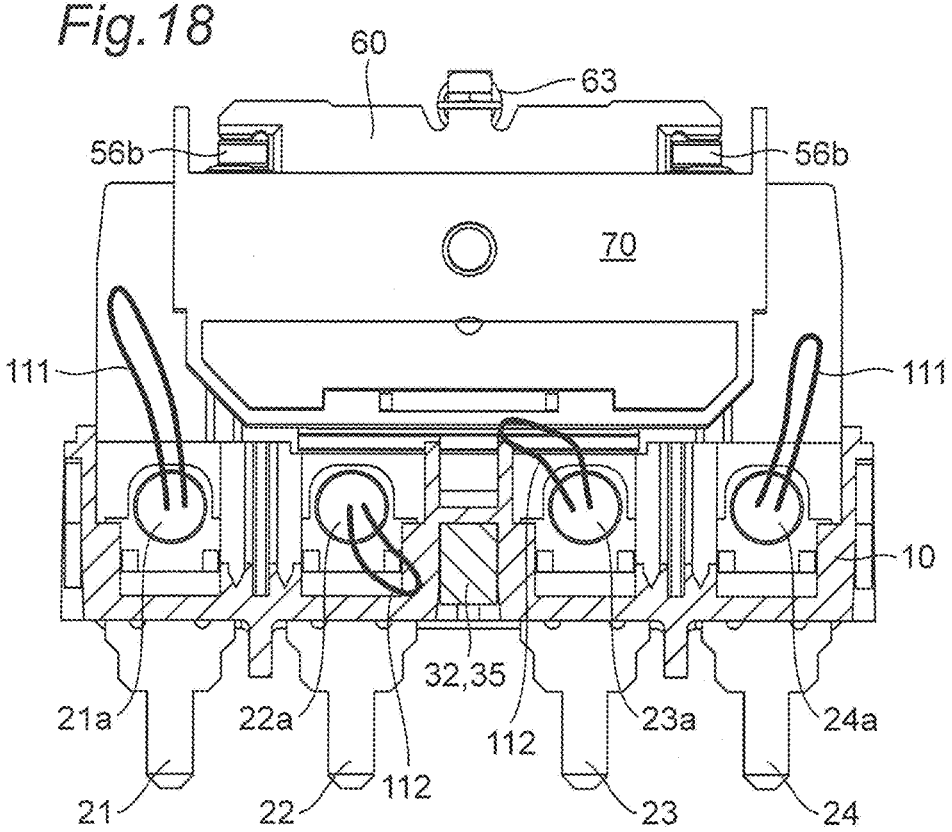
FIG. 18 is a front sectional view of an electromagnetic relay according to a second embodiment.
Figure 19:
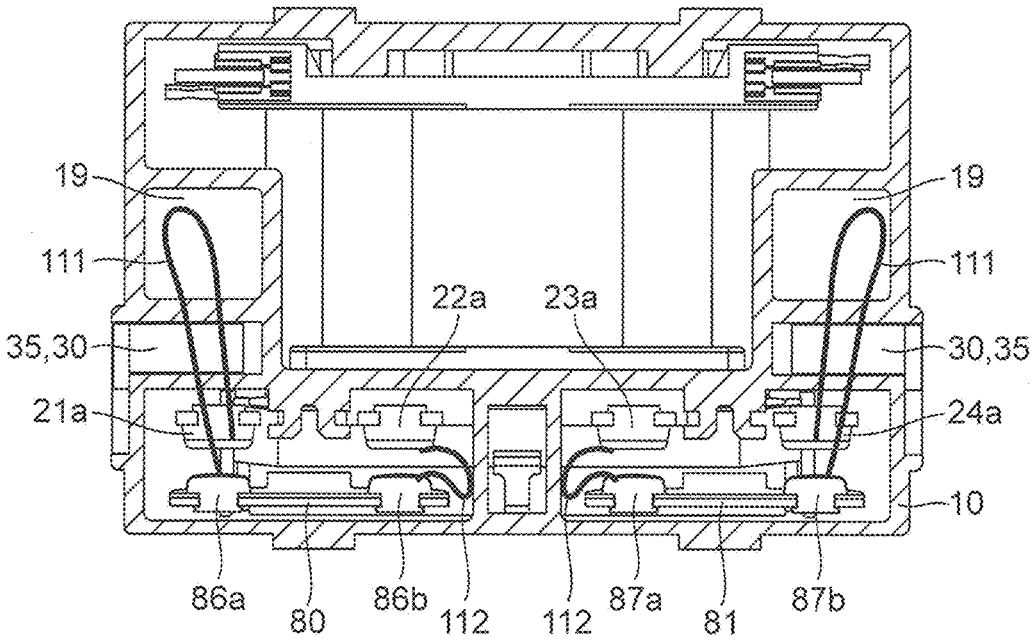
FIG. 19 is a plan sectional view of the electromagnetic relay shown in FIG. 18.
Figure 20:
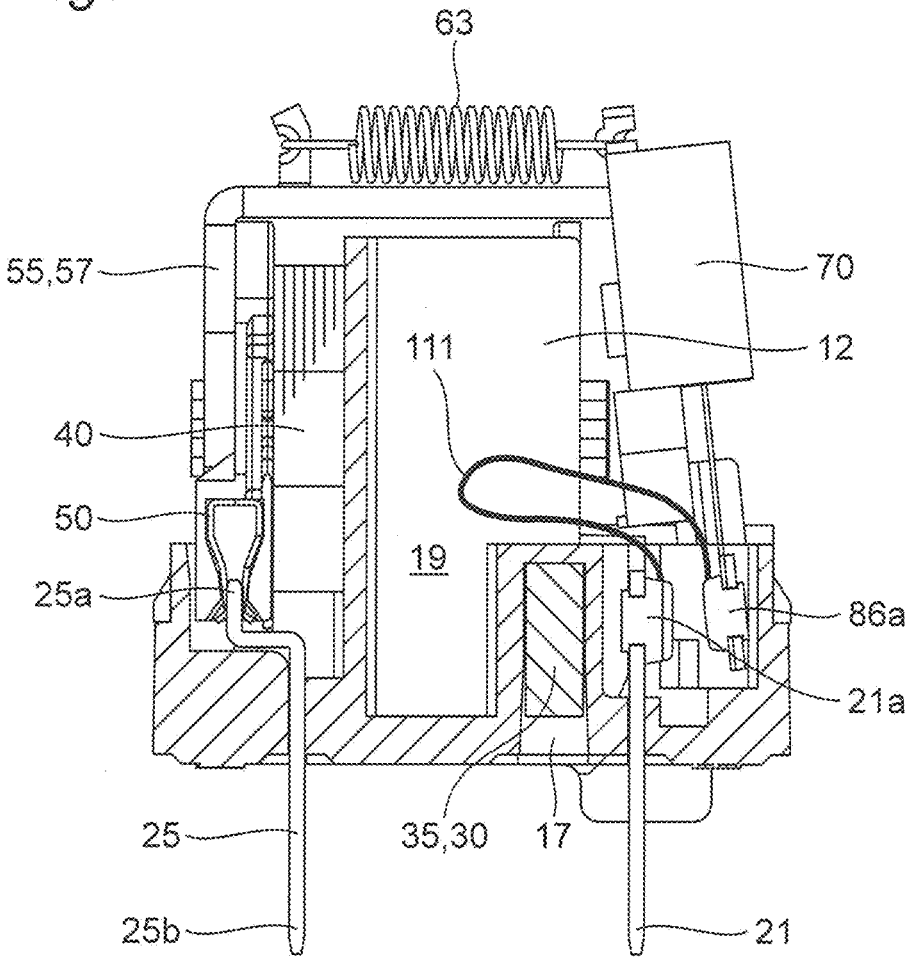
FIG. 20 is a left side sectional view of the electromagnetic relay shown in FIG. 18.

As shown in FIGS. 18 to 20, a second embodiment is almost the same as the above first embodiment, and is different therefrom in that the auxiliary yoke is not provided in the magnetic field generation unit 35. It is also different in that the magnetic flux density of the first permanent magnet 30 is made larger than the magnetic flux density of the second permanent magnet 32.

The same portions are provided with the same numerals and descriptions thereof are omitted.

In the present embodiment, for example, as shown in FIGS. 18 and 19, the magnetic flux density of the first permanent magnet 30 is made larger than the magnetic flux density of the second permanent magnet 32. For this reason, large magnetic force acts on an arc 111 generated between the fixed contact 24*a* and the movable contact 87*b* than on an arc 112 generated between the fixed contact 23*a* and the movable contact 87*a*. As a result, when a movable contact piece 81 rotates and returns, the time taken for the arc 111 generated between the fixed contact 24*a* and the movable contact 87*b* to be extended by the first permanent magnet 30 to a predetermined length is shorter than the time taken for the arc 112 generated between the fixed contact 23*a* and the movable contact 87*a* to be extended by the second permanent magnet 32 to a predetermined length.

In short, the time taken for the arc 111 to be extended to a predetermined length is shorter than that for the arc 112.

Accordingly, in the same time period, the arc 111 generated between the fixed contact 24*a* and the movable contact 57*b* can be extended longer than the arc 112 generated between the fixed contact 23*a* and the movable contact 37*a*. When the arc 111 is attracted by the first permanent magnet 30 to the arc extinguishing space 19 and cut off, the arc 112 is simultaneously cut off since the movable contact 87*a* and the movable contact 87*b* are electrically connected with each other. Accordingly, the arc 112 can be cut off before being extended long.

When the arc 111 is extended to a sufficient length and can be cut off early, it is possible to reduce insulation deterioration in the spaces between the fixed contacts 24*a*, 23*a* and the movable contacts 87*b*, 87*a* due to heat generation of the arcs 111, 112. It is thereby possible to prevent regeneration of the arcs 111, 112.

According to the present embodiment, the arc 111 can be extended longer than the arc 112 within the same time period. For this reason, when the generated arc 111 is extended to the sufficient strength and can be cut off before extension of the arc 112, the arc 112 is simultaneously cut off and thus need not be extended long. As a result, a large space is not needed for extinguishing the arc 112. Further, the arc 112 does not come into contact with a resin meld, not causing the problem of insulation deterioration due to generation of dust and an organic gas.

Thus, according to the present embodiment, it is possible to obtain a small-sized electromagnetic relay where the problem of insulation deterioration caused by an arc does not occur even when a large current is allowed to flow.

Figure 21:
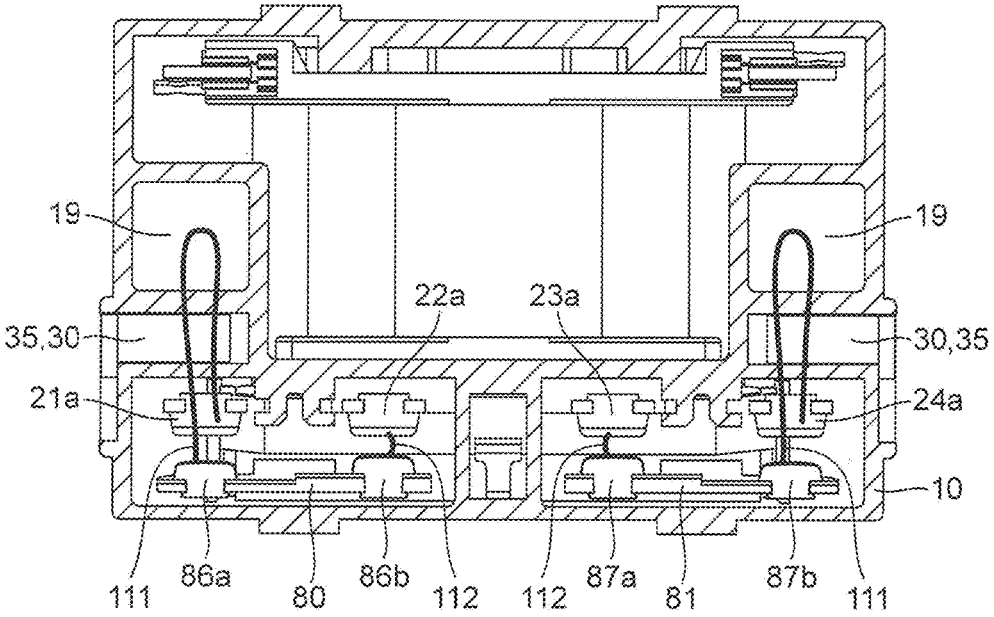
FIG. 21 is a plan sectional view according to a third embodiment.
Figure 22:
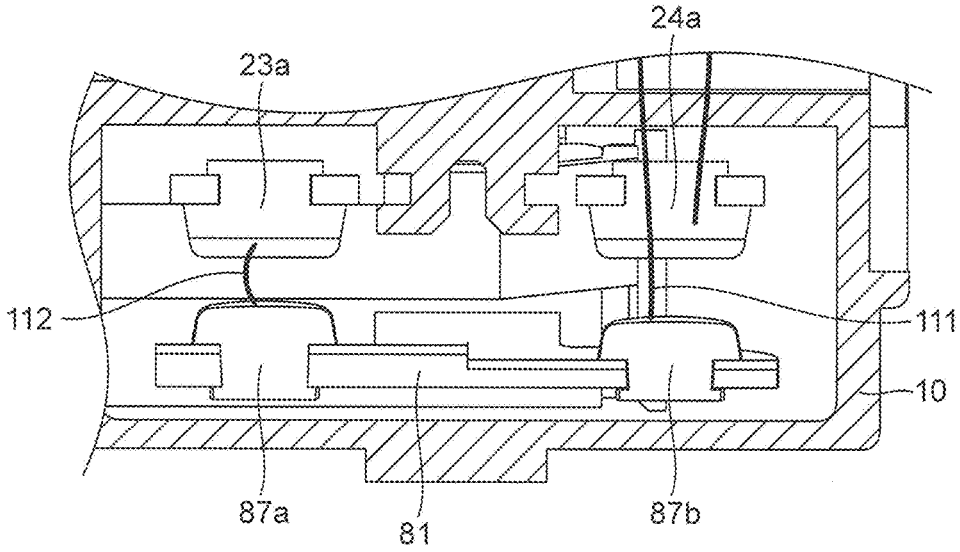
FIG. 22 is a partial enlarged view of the plan sectional view shown in FIG. 21.

As shown in FIGS. 21 and 22, a third embodiment is a case where a stepped portion is provided in thickness dimensions of the movable contact pieces 80, 81, and the movable contacts 86*a*, 86*b* and the movable contacts 87*a*, 87*b* which have the same height dimension are respectively fixed. For this reason, a contact-to-contact distance between the fixed contact 21*a* and the movable contact 86*a* is larger than a contact-to-contact distance between the fixed contact 22*a* and the movable contact 86*b*. Similarly, a contact-to-contact distance between the fixed contact 24*a* and the movable contact 87*b* is larger than a contact-to-contact distance between the fixed contact 23*a* and the movable contact 87*a*.

Thus, for example as shown in FIG. 22, at the time of rotating and returning the movable contact piece 81 in an operating state, before separation of the movable contact 87*a* from the fixed contact 23*a*, namely before generation of the arc 112, the movable contact 87*b* is separated from the fixed contact 24*a* and the arc 111 is generated.

That is, before generation of the arc 112 or at the time of generation of the arc 112, the arc 111 is in the state of having already been extended long by the first permanent magnet 30. When the arc 111 is extended to the sufficient length by use of the arc extinguishing space 19 and cut off, the arc 112 is simultaneously cut off since the movable contact 87*a* and the movable contact 87*b* are electrically connected with each other. Accordingly, the arc 112 can be cut off before being extended long.

When the arc 111 is extended to the sufficient length and cut off, it is possible to reduce insulation deterioration in the spaces between the fixed contacts 24*a*, 23*a* and the movable contacts 87*b*, 87*a* due to heat generation of the arcs 111, 112. It is thereby possible to prevent regeneration of the arcs 111, 112.

According to the present embodiment, the distance between contacts can be adjusted only by providing the movable contacts 86*a*, 86*b*, 87*a*, 87*b* on the movable contact pieces 80, 81 with a stepped portion provided therebetween. This enables simple adjustment of the timing for generation of the arc 111 and the arc 112.

That is, when the distance between contacts is adjusted to an appropriate size, the arc 111 can be extended to the sufficient length by the second permanent magnet 32 before generation of the arc 112. Thus, when the arc 111 is extended to the sufficient length by the first permanent magnet 30 and attracted to the arc extinguishing space 19 and cut off, the arc 112 is simultaneously cut off since the movable contact 87*a* and the movable contact 87*b* are electrically connected with each other. Accordingly, the arc 112 can be cut off before being extended long. As a result, a large space is not needed for extinguishing the arc 112. Further, the arc 112 does not come into contact with the resin mold, not causing the problem of insulation deterioration due to generation of dust and an organic gas.

Thus, according to the present embodiment, it is possible to obtain a small-sized electromagnetic relay where the problem of insulation deterioration caused by an arc is prevented from occurring only by forming a simple structure of adjusting a distance between the contacts even when a large current is allowed to flow.

Figure 23:
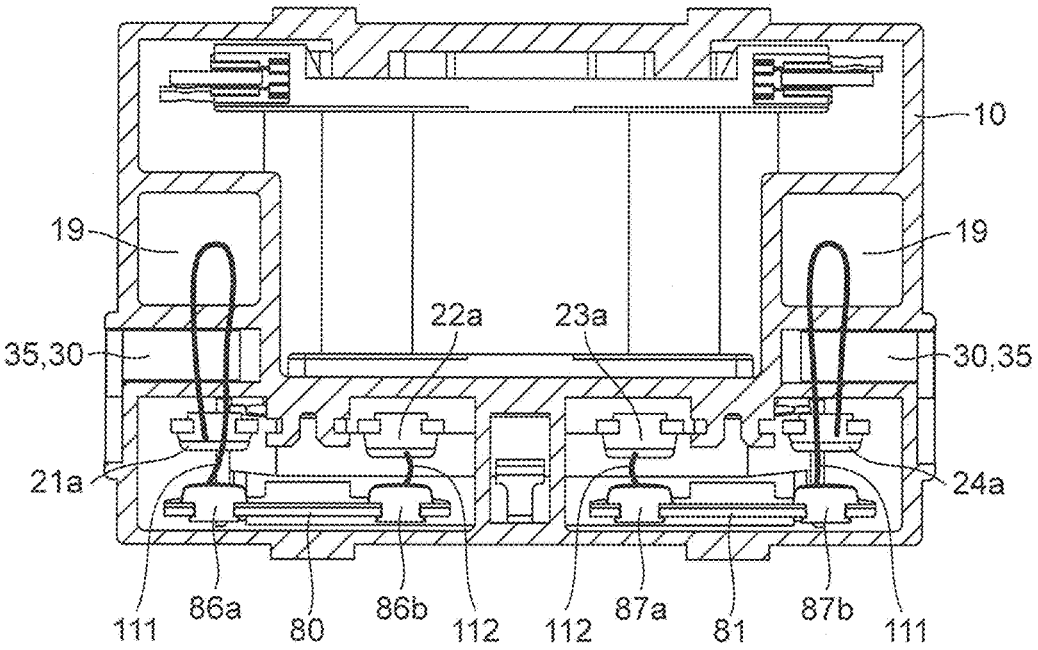
FIG. 23 is a plan sectional view according to a fourth embodiment.
Figure 24:
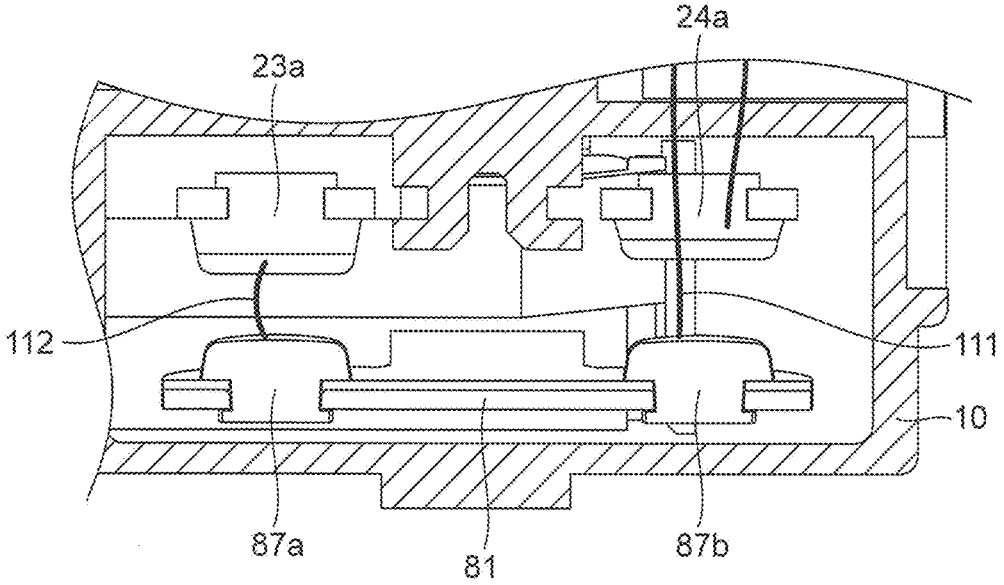
FIG. 24 is a partial enlarged view of the plan sectional view shown in FIG. 23.

As shown in FIGS. 23 and 24, a fourth embodiment is a case where a height dimension of the fixed contact 21*a* is made smaller than a height dimension of the fixed contact 22*a*, and a height dimension of the fixed contact 24*a* is made smaller than a height dimension of the fixed contact 23*a*, to thereby adjust the distances between the contacts.

Hence, the contact-to-contact distance between the fixed contact 21*a* and the movable contact 86*a* is larger than the contact-to-contact distance between the fixed contact 22*a* and the movable contact 86*b*. Similarly, the contact-to-contact distance between the fixed contact 24*a* and the movable contact 87*b* is larger than the contact-to-contact distance between the fixed contact 23*a* and the movable contact 87*a*.

In the present embodiment, as shown in FIG. 24, at the time of rotating and returning the movable contact piece 81 in the operating state, before separation of the movable contact 87*a* from the fixed contact 23*a*, namely before generation of the arc 112, the movable contact 87*b* is separated from the fixed contact 24*a* and the arc 111 is generated. Thus, before generation of the arc 112 or at the time of generation of the arc 112, the arc 111 is in the state of having already been extended long by the first permanent magnet 30. As a result, when the arc 111 is extended to the sufficient length by use of the arc extinguishing space 19 and cut off, the arc 112 is simultaneously cut off since the movable contact 87*a* and the movable contact 87*b* are electrically connected with each other. Accordingly, the arc 112 can be cut off before being extended long.

When the arc 111 is extended to the sufficient length and cut off, it is possible to reduce insulation deterioration in the spaces between the fixed contacts 24*a*, 23*a* and the movable contacts 87*b*, 87*a* due to heat generation of the arcs 111, 112. It is thereby possible to prevent regeneration of the arcs 111, 112.

According to the present embodiment, it is possible to adjust the distance between the contacts only by reducing the height dimensions of the fixed contacts 21*a*, 24*a*. This enables simple adjustment of the timing for generation of the arc 111 and the arc 112.

That is, when the distance between contacts is adjusted to an appropriate value, the arc 111 can be extended to the sufficient length by the second permanent magnet 32 before generation of the arc 112 or at the time of generation of the arc 112. Thus, when the arc 111 is extended to the sufficient length by the first permanent magnet 30 and attracted to the arc extinguishing space 19 and cut off, the arc 112 is simultaneously cut off since the movable contact 87*a* and the movable contact 87*b* are electrically connected with each other. Accordingly, the arc 112 can be cut off before being extended long.

Needless to say, the distance between the contacts may be adjusted by making the height dimensions different between the pair of adjacent movable contacts 86*a*, 86*b* or the pair of adjacent movable contacts 87*a*, 87*b*.

Figure 25:
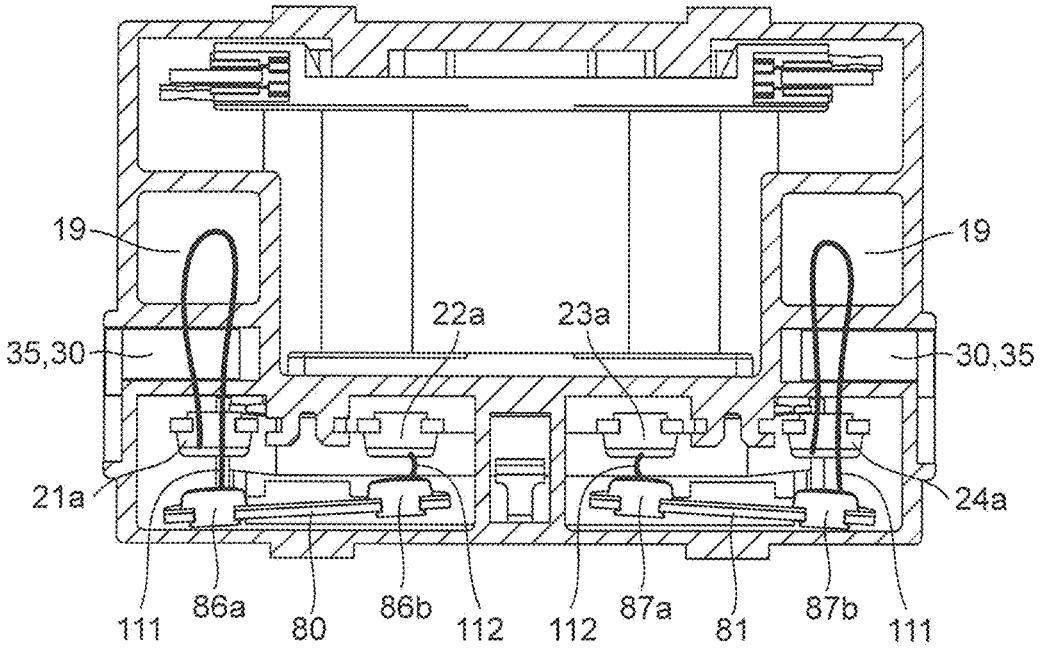
FIG. 25 is a plan sectional view according to a fifth embodiment.
Figure 26:
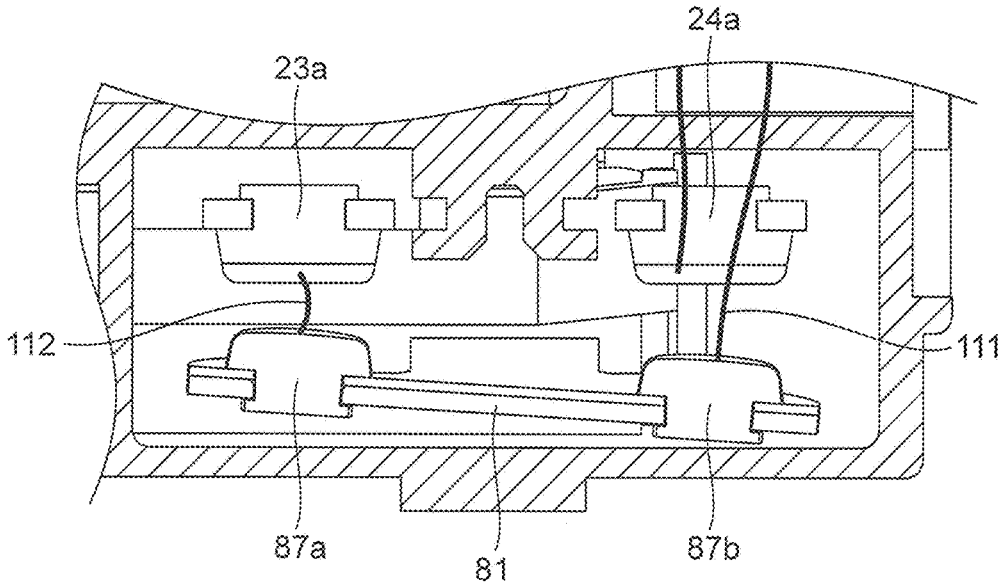
FIG. 26 is a partial enlarged view of the plan sectional view shown in FIG. 25.

In a fifth embodiment, as shown in FIGS. 25 and 26, the contact-to-contact distance between the fixed contact 21*a* and the movable contact 86*a* is made larger than the contact-to-contact distance between the fixed contact 22*a* and the movable contact 86*b* by inclining the movable contact piece 80. Similarly, the contact-to-contact distance between the fixed contact 24*a* and the movable contact 87*b* is made larger than the contact-to-contact distance between the fixed contact 23*a* and the movable contact 87*a* by inclining the movable contact piece 81. However, the contact-to-contact distance between the fixed contact 21*a* and the movable contact 86*a* is the same as the fixed contact 24*a* and the movable contact 87*b*.

In the present embodiment, as shown in FIG. 26, at the time of rotating and returning the movable contact piece 81 in the operating state, before separation of the movable contact 87*a* from the fixed contact 23*a*, namely before generation of the arc 112, the movable contact 87*b* is separated from the fixed contact 24*a* and the arc 111 is generated. Thus, before generation of the arc 112 or at the time of generation of the arc 112, the arc 111 is in the stale of having already been extended long by the first permanent magnet 30. As a result, when the arc 111 is extended to the sufficient length by use of the arc extinguishing space 19 and cut off, the arc 112 is simultaneously cut off since the movable contact 87*a* and the movable contact 87*b* are electrically connected with each other. Accordingly, the arc 112 can be cut off before being extended long.

When the arc 111 is extended to the sufficient length and cut off, it is possible to reduce insulation deterioration in the spaces between the fixed contacts 24*a*, 23*a* and the movable contacts 87*b*, 87*a* due to heat generation of the arcs 111, 112. It is thereby possible to prevent regeneration of the arcs 111, 112.

According to the present embodiment, only by performing torsion processing on the movable contact pieces 80, 81 which are existing components, it is possible to incline the movable contact pieces 80, 81. There is thus an advantage that installation of a new manufacturing facilities can be reduced to prevent a cost increase.

The generation status of arcs in the case of applying a high load to the electromagnetic relay according to the above embodiment was measured as follows:

Working Example 3

In a working example 3, measurement was performed on the electromagnetic relay according to the second embodiment (FIGS. 18 to 20) where the auxiliary yoke is not provided and ail distances between the contacts are made the same.

A magnetic flux density in the vicinities of the contacts at the time of contacting between the fixed contacts 21*a*, 24*a* and the movable contacts 86*a*, 87*b* by the first permanent magnet 30 was set to 46 mT. A magnetic flux density in the vicinities of the contacts at the time of contacting between the fixed contacts 22*a*, 23*a* and the movable contacts 86*b*, 87*a* by the second permanent magnet 32 was set to 24 mT.

The fixed contact terminal 22 and the fixed contact terminal 23 were connected with each other via a resistor, not shown, and the generation status of arcs was measured in the case of applying a voltage of 1000V between the fixed contact terminal 21 and the fixed contact terminal 24. Note that a value of the resistor has been set such that a current of 15A flows in a state where each of the fixed contacts 21*a*, 22*a*, 23*a*, 24*a* and the movable contacts 86*a*, 86*b*, 87*a*, 87*b* come into contact. A graph of FIG. 27 shows measurement results.

In FIG. 27, "V1" shows a voltage between the fixed contact 21*a* and the movable contact 86*a*. "V2" shows a voltage between the fixed contact 22*a* and the movable contact 86*b*. V3 shows a voltage between the fixed contact 23*a* and the movable contact 87*a*. "V4" shows a voltage between the fixed contact 24*a* and the movable contact 87*b*. Further, "t1" shows the time from the generation of the arc at the time of separation between the fixed contacts 21*a*, 22*a*, 23*a*, 24*a* and the movable contacts 86*a*, 86*b*, 37*a*, 87*b* to the start of extension of the arc. "t2" shows the time from the start of extension of the arc to the completion of cut-off of the arc. "t1+t2" shows arc continuation time. As for "V1", "V2", "V3", "V4", "t1", and "t2", the same applies to FIGS. 28 and 29 described later.

In the graph of FIG. 27, a magnetic flux density of the first permanent magnet 30 has been made higher than a magnetic flux densities of the second permanent magnet 32, as compared with a comparative example 1 (FIG. 29) described later. It could thus be confirmed that the time "t1" from the generation of the arc at the time of separation between the fixed contacts 21*a*, 24*a* and the movable contacts 86*a*, 87*b* to the start of extension of the arc was short.

Further, it could thus be confirmed that the arc continuation time "t1+t2" for each of arcs between the fixed contacts 21*a*, 22*a*, 23*a*, 24*a* and the movable contacts 36*a*, 86*b*, 87*a*, 87*b* was short.

Further, according to the graph of FIG. 27, it could also be confirmed that the number of vibrations in voltage waveform showing the generation, extension, and cut-off of the arc during the time "t2" was smaller at the time of completion of the vibrations than the number of vibrations in voltage waveform in the comparative example 1.

In particular, the numbers of vibrations in contact-to-contact voltages "V2", "V3" between the fixed contacts 22*a*, 23*a* and the movable contacts 86*b*, 87*a*, disposed in the vicinity of the resin mold, were small. It was thus found possible to reliably extinguish the arc and reduce generation of dust and an organic gas caused by generation of the arc, and thereby to reliably prevent insulation deterioration.

Working Example 4

In a working example 4, measurement was performed on the electromagnetic relay according to the fifth embodiment (FIGS. 25 and 26) where the auxiliary yoke is not provided and all distances between the contacts are not uniform.

A magnetic flux density in the vicinities of the contacts at the time of contacting between the fixed contacts 21*a*, 22*a*, 23*a*, 24*a* and the movable contacts 86*a*, 86*b*, 87*a*, 87*b* by the first and second permanent magnets 30, 32 was set to 24 mT. The fixed contact terminal 22 and the fixed contact terminal 23 were connected with each other via a resistor, not shown, and a voltage of 1000V was applied between the fixed contact terminal 21 and the fixed contact terminal 24, to measure the generation status of arcs. A graph of FIG. 28 shows measurement results.

According to the graph of FIG. 28, as compared with the comparative example 1 (FIG. 29) described later, the contact-to-contact distances between the fixed contacts 21*a*, 24*a* and the movable contacts 86*a*, 87*b* are made larger than the contact-to-contact distances between the fixed contacts 22*a*, 23*a* and the movable contacts 86*b*, 87*a*. It could thus be confirmed that the arc continuation time "t1+t2" for each of arcs between the fixed contacts 21*a*, 22*a*, 23*a*, 24*a* and the movable contacts 88*a*, 86*b*, 87*a*, 87*b* was short.

Further, according to the graph of FIG. 28, it could also be confirmed that the number of vibrations in voltage waveform showing the generation, extension, and cut-off of the arc during the time "t2" was smaller at the time of completion of the vibrations than the number of vibrations in voltage waveform in the comparative example 1.

In particular, the numbers of vibrations in contact-to-contact voltages "V2", "V1" between the fixed contacts 22*a*, 23*a* and the movable contacts 86*b*, 87*a*, disposed in the vicinity of the resin mold, were small. It was thus found possible to reliably extinguish the arc and reduce generation of dust and an organic gas caused by generation of the arc, and thereby to reliably prevent insulation deterioration.

Comparative Example 1

In the comparative example 1, the generation status of arcs were measured on similar conditions to those in the working example 3 described above except that the magnetic flux density in the vicinities of the contacts at the time of contacting between the fixed contacts 21*a*, 22*a*, 23*a*, 24*a* and the movable contacts 86*a*, 86*b*, 87*a*, 87*b* by the first and second permanent magnets 30, 32 was set to 24 mT. A graph of FIG. 29 shows measurement results.

According to the graph of FIG. 29, it could be confirmed that the arc continuation time "t1+t2" for each of arcs respectively generated between the movable contacts 86*a*, 86*b*, 87*a*, 87*b* and the facing fixed contacts 21*a*, 22*a*, 23*a*, 24*a* was longer than the arc continuation time "t1+t2" in working examples 3, 4. It was consequently found that the arc continuation time can be reduced by appropriately varying the magnetic flux density or the contact spacing.

Further, the number of vibrations in voltage waveform showing the generation, extension, and cut-off of the arc during the time "t2" was larger than the number of vibrations in working examples 3, 4. In particular, the numbers of vibrations in contact-to-contact voltages "V2", "V3" between the fixed contact 22*a* and the fixed contact 23*a*, disposed in the vicinity of the resin mold, were greatly larger than the number of vibrations in working examples 3, 4. It was found from this fact that the arc is repeatedly generated, extended, and cut-off a number of times.

Working Example 5

The fixed contact terminal 22 and the fixed contact terminal 23 of the electromagnetic relay in the second embodiment (FIG. 30) were connected with each other via a resistor, not shown, and a voltage of 1000V was applied between the fixed contact terminal 21 and the fixed contact terminal 24, to conduct an open and close test to measure the generation status of arcs.

More specifically, a voltage between the contacts was measured by an oscilloscope to obtain a waveform showing a change in voltage between the contacts. Further, the generated arc was photographed by a high-speed camera, and the photographed image of the arc was subjected to image processing to measure a length of the arc. The arc length is then plotted on a waveform of the voltage between the contacts to obtain a graph (FIG. 31) showing the relation among the arc continuation time, the voltage between the contacts, and the arc length.

Figure 30:
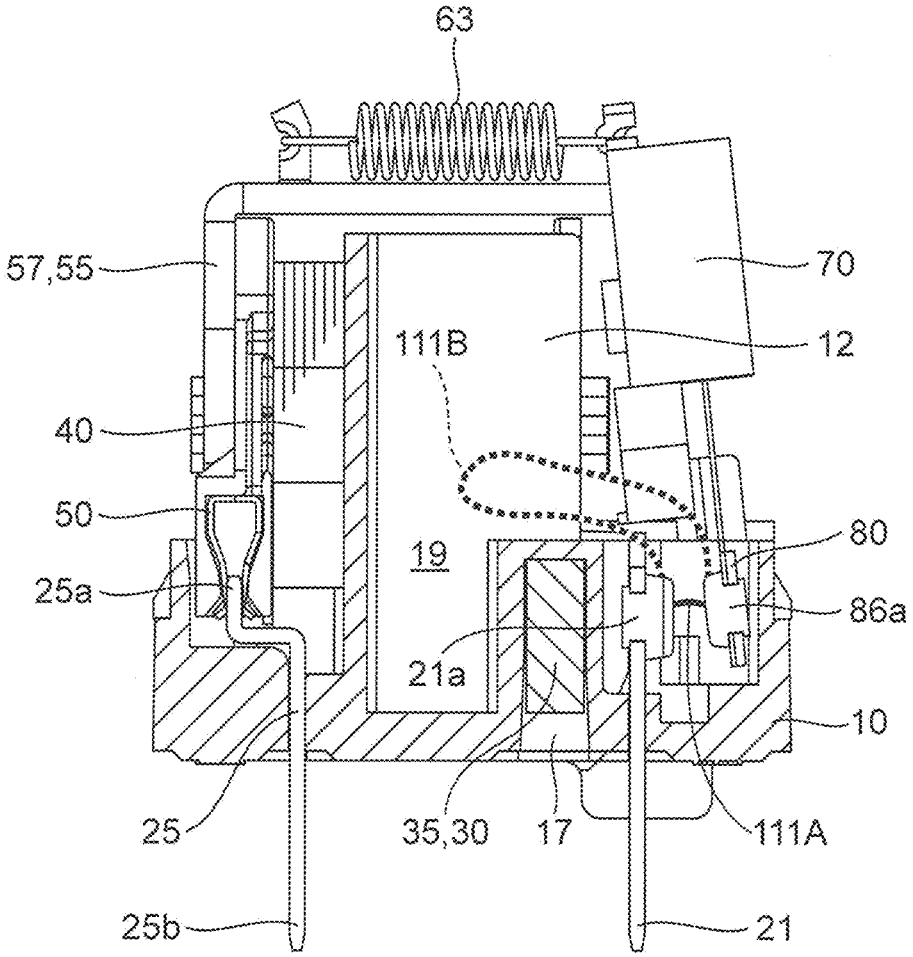
FIG. 30 is a left side sectional view of the electromagnetic relay according to the second embodiment.
Figure 31:
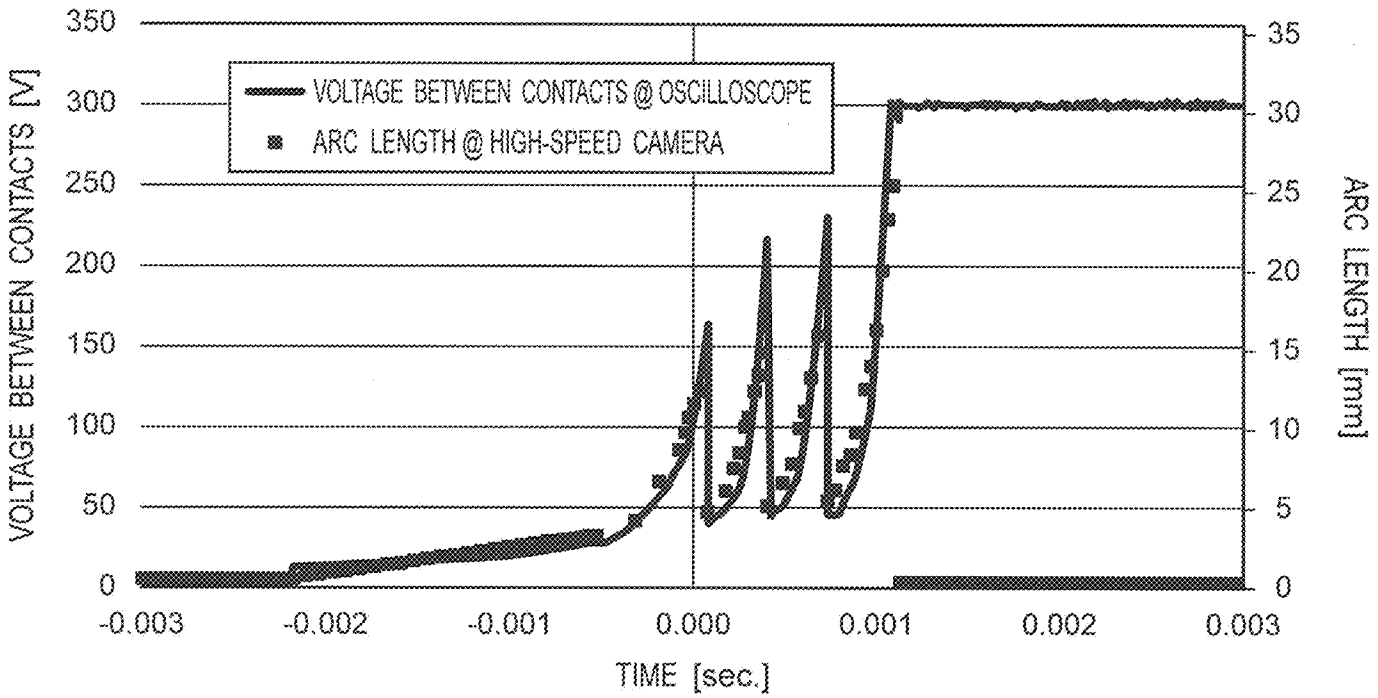
FIG. 31 is a graph according to a working example 5

It could be confirmed from FIG. 31 that the following cycle is repeated: the movable contact piece 80 shown in FIG. 30 is rotated in the direction from the operating position to the returned position, and when the movable contact 66*a* is separated from the fixed contact 21*a*, an arc 111A is generated, and an arc 111B extended by the permanent magnet 30 is cut off. It could also be confirmed that there is a correlation between the voltage between the contacts and the arc length.

Describing it in more detail, when a high voltage is applied, the arc 111A is generated between the fixed contact 21*a* and the movable contact 86*a* at the moment of separation of the movable contact 86*a* from the fixed contact 21*a*. In an initial stage of the separating operation, as the distance between the contacts increases, the arc 111A extends in proportion to this increase, and the arc 111A reaches an arc length almost equivalent to the distance between the contacts (about 3 mm).

Subsequently, the arc 111A is extended by the magnetic force of the first permanent magnet 30, and extended longer than the contact-to-contact distance between the facing fixed contact 21*a* and movable contact 86*a*, to become the arc 111B. When insulation resistance in the space where the arc 111B is present becomes larger than insulation resistance in the space located between the facing fixed contact 21*a* and the movable contact 86*a*, the new arc 111A is generated between the fixed contact 21*a* and the movable contact 86*a*. Simultaneously with this, the extended arc 111B is cut off. The generated new arc 111A is then extended by the magnetic force of the first permanent magnet. 30 in the same manner as described above. Thereafter, a phenomenon of generation of the arc 111A and cut-off of the extended arc 111B is repeated in a similar cycle to the above.

Normally, in an electromagnetic relay (FIG. 19) having a double break contact structure as in the second embodiment, as the movable contact piece 80 is rotated, the arcs 111, 112 are respectively simultaneously generated between the movable contacts 86*a* (87*b*) and the fixed contacts 21*a* (24*a*) and between the movable contacts 86*a* (87*a*) and the fixed contacts 22*a* (23*a*), and are extended in the same manner.

However, in the electromagnetic relay according to the second embodiment, the arc 112 easily comes into contact with the resin mold disposed in the vicinity of the fixed contacts 22*a* (23*a*), and dust or an organic gas is thus easily generated. If the dust or the organic gas is generated by the arc 112 coming into contact with the resin mold, insulation deterioration occurs in the internal space to cause a decrease in insulation resistance. Accordingly, for example between the movable contacts 86*b* (87*a*) and the fixed contacts 22*a* (23*a*), the arc 112 is more easily generated. As a result, even after complete return of the movable contacts 86*a*, 86*b*, the arcs 111, 112 are repeatedly generated, extended, and cut off, and the time for completely cutting off the arcs 111, 112 thus becomes long. This causes a vicious cycle of bringing the repeatedly generated arc into contact with the resin mold, generating dust or an organic gas, and shortening the lifetime of the contact.

Accordingly, based on the foregoing knowledge, the present inventors preferentially attracted the arc 111 generated between the movable contacts 86*a* (87*b*) and the fixed contacts 21*a* (24*a*), in the vicinities of which the resin mold is not disposed, by the magnetic force of the first permanent magnet 30 to extend and early cut off the arc. Accordingly, even when the arc 112 is generated between the movable contacts 86*b* (87*a*) and the fixed contacts 22*a* (23*a*), in the vicinities of which the resin mold is disposed, the arc 112 can be cut off simultaneously with the arc 111 before extension of the arc 112. Consequently, the present inventors confirmed that the problem caused by generation of the arc 112 can be solved, and completed the present invention.

INDUSTRIAL APPLICABILITY

The present invention is not restricted to the DC electromagnetic relay, but may be applied to an AC electromagnetic relay.

Although the cases of applying the present invention to the electromagnetic relay with the four poles have been described in the above embodiments, this is not restrictive, and it may be applied to an electromagnetic relay with at least one pole.

Needless to say, the present invention is applicable to an electromagnetic relay with two or more poles where two or more movable contacts are provided on one movable contact piece.

Further, the present invention is not restricted to the electromagnetic relay, but may be applied to a switch.

REFERENCE SIGNS LIST

10: base

10*a*: engaging claw portion

11: recessed portion
12: partition wall
13: stepped portion
14: press-fitting hole
15*a*,15*b*,15*c*,15*d*: terminal hole
16*a*,16*b*: terminal hole
17: notched groove
18: recessed portion
19: arc extinguishing space
21-24: fixed contact terminal
21*a*-24*a*: fixed contact
25: coil terminal
25*a*: connection portion
25*b*: terminal portion
30: first permanent magnet
31: auxiliary yoke
32: second permanent magnet
35: magnetic field generation unit
40: electromagnetic block
41: spool
42,43: flange portion
44: trunk portion
45: through hole
46: insulating rib
47: engaging hole
50: relay clip
51: coil
52: iron core
53: magnetic pole portion
55: yoke
60: movable iron piece
70: spacer
71: recessed portion
72: insulating rib
73: insulating rib
74: movable stage
80: movable contact piece
81: movable contact piece
82: large width portion
83: large width portion
84: lining member
85: lining member
86*a*,86*b*: movable contact
87*a*,87*b*: movable contact
90: cover
91: gas releasing hole
92: engagement receiving portion
93: position regulation rib
100: arc cut-off member
101: projection
102: rib
103: rib
104: tongue member
110: arc
111: arc
111A: arc
111B: arc
112: arc

The invention claimed is:

1. An electromagnetic relay, comprising:

a first movable contact and a second movable contact which are disposed on a movable contact piece;

a first fixed contact and a second fixed contact which are disposed so as to contactably and separably face the first movable contact and the second movable contact; and a magnetic field generation unit that generates a first magnetic field having a first magnetic flux density to attract in a predetermined direction an arc generated between the first movable contact and the first fixed contact and that generates a second magnetic field having a second magnetic flux density to attract in a predetermined direction an arc generated between the second movable contact and the second fixed contact, wherein, the first magnetic flux density between the first movable contact and the first fixed contact is larger than the second magnetic flux density between the second movable contact and the second fixed contact.

2. The electromagnetic relay according to claim 1, wherein the arc generated between the first movable contact and the first fixed contact is attracted and extended to an arc extinguishing space that is disposed in a direction that, as seen from the first movable contact or the first fixed contact, is opposite to the facing first fixed contact or the facing first movable contact.

3. The electromagnetic relay according to claim 1, wherein the magnetic field generation unit comprises a first magnet that generates the first magnetic field having the first magnetic flux density and a second magnet that generates the second magnetic field having the second magnetic flux density.

* * * * *